United States Patent [19]

Dollison

[11] Patent Number: 4,691,511

[45] Date of Patent: Sep. 8, 1987

[54] HYDRAULIC WELL PUMP

[75] Inventor: William W. Dollison, Dallas, Tex.

[73] Assignee: Otis Engineering Corporation, Dallas, Tex.

[21] Appl. No.: 790,417

[22] Filed: Oct. 23, 1985

Related U.S. Application Data

[62] Division of Ser. No. 449,823, Dec. 14, 1982, Pat. No. 4,571,939.

[51] Int. Cl.[4] ..... F16D 31/02

[52] U.S. Cl. ..... 60/414; 60/415; 60/416

[58] Field of Search ..... 60/413–416; 91/304–306, 308, 39, 40, 50, 51, 47, 462, 464; 137/624.13, 624.14, 596.18

[56] References Cited

U.S. PATENT DOCUMENTS

| | | | |
|---|---|---|---|
| 2,402,848 | 6/1946 | Senn | 92/111 |
| 2,441,925 | 5/1948 | Wege | 91/171 |
| 2,561,786 | 7/1951 | Davis | 137/567 X |
| 2,572,748 | 10/1951 | Noll et al. | 60/383 X |
| 3,335,525 | 8/1967 | Muehling | 91/37 X |
| 3,620,126 | 11/1971 | Fuhrimann | 91/280 |
| 3,919,923 | 11/1975 | Haigh | 137/82 X |
| 4,167,098 | 9/1979 | James | 60/372 X |
| 4,188,787 | 2/1980 | Bromell et al. | 417/217 X |
| 4,546,607 | 10/1985 | Kime | 60/414 |

FOREIGN PATENT DOCUMENTS

| | | | |
|---|---|---|---|
| 295290 | 3/1928 | United Kingdom | 91/51 |

*Primary Examiner*—Edward K. Look

[57] ABSTRACT

A hydraulic well pump for operating a pump sucker rod string including a hydraulic cylinder assembly for raising and lowering the sucker rod string and a fluid counterbalancing system for offsetting the combined weight of the reciprocating service equipment, the fluid column above the pump plunger, and the sucker rod string. One counterbalancing embodiment includes an air supported piston on the movable cylinder exposed to an air chamber below the air piston functioning independently of the hydraulic and power and logic system of the pump. Another counterbalancing system embodiment uses a hydraulic fluid accumulator connected into the system fluid power and logic for supercharging the hydraulic power pumps during the lift stroke and providing opposing force during the downstroke. Also disclosed are: a stroke length multiplier apparatus including a multi-layered strip metal tension member; a pump stroke sensor and control for adjusting stroke end limits and lengths; and a fluid logic system for controlling stroke acceleration and deceleration.

10 Claims, 37 Drawing Figures

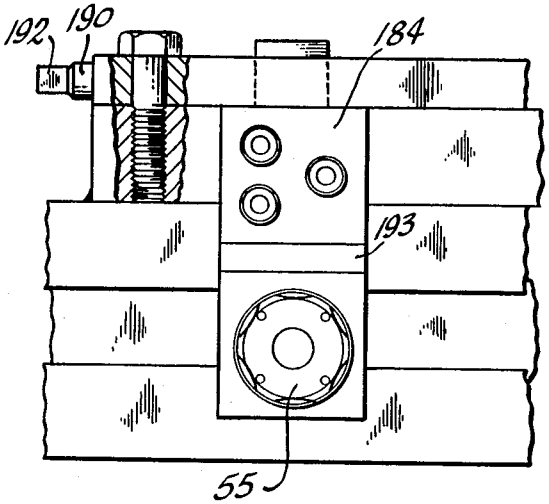
FIG. 11
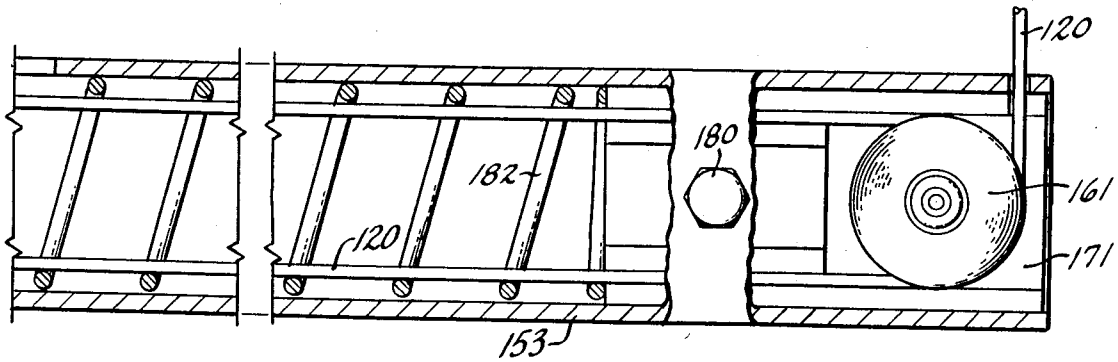
FIG. 10-B

HYDRAULIC WELL PUMP

This is a division of U.S. patent application Ser. No. 449,823 filed Dec. 14, 1982, now U.S. Pat. No. 4,571,939.

This invention relates to hydraulic piston power systems and more particularly to hydraulic well pumps.

Often it is necessry to produce wells such as oil wells by pumping. One of the most commonly used well pumping systems includes a downhole reciprocating pump having a plunger which is raised and lowered by a sucker rod string connected at the surface end of the well with a walking beam. The walking beam is generally driven by pitman arms connected with crank arms rotated by a shaft which is driven by an electric motor or an internal combustion engine of the gasoline or diesel type. The motor or engine is coupled with the shaft through belts, chains, and some form of transmission. Counterweights are generally mounted on the crank arms. The center of the walking beam is pivoted on a samson post at a sufficient height to permit the beam to be rocked by the pitman arms for raising and lowering the sucker rod string in the well. The conventional walking beam type pumping jack or unit is an ineffecient system having many bearings and other parts which are subject to wear and often is quite large and expensive where used on deep wells. For example, such a pump having a stroke of twenty feet may be forty feet high. Obviously such a pump will have a large, long walking beam and quite heavy counterweights. Some deep wells have even been known to use pumps having an eighty foot stroke. The massive components of such a pumping system which must be moved during the operation of the pump causes substantial wear in the many bearings, gears, and other elements in the drive system requiring time consuming and expensive maintenance. Additionally such forces as those caused particularly by "rod pound" which is the reaction of the pump piston to hitting liquid in the well bore transmits shock forces to the walking beam, pitman arms, and cranks as well as the gears and other parts of the system contributing to additional wear. Further disadvantages of the walking beam type well pump include limitations on the length of stroke of the pump and thus the length of the reciprocating movement of the sucker rod. Still further disadvantages of the walking beam type pump include the difficulty of satisfactorily hiding or enclosing the pump and noise produced by the pumping apparatus making it difficult to place such pumps in populated areas.

It is therefore a principal object of the invention to provide a new and improved well pump.

It is another object of the invention to provide a hydraulic piston powered well pump which is more compact and light in weight than conventional pumps.

It is another object of the invention to provide a hydraulic well pump which is less expensive to manufacture than conventional well pumps.

It is another object of the invention to provide a new and improved well pump which can be operated with the same length stroke as a conventional walking beam type pump using apparatus having approximately half the height of such conventional equipment.

It is another object of the invention to provide a hydraulically powered well pump which uses a hydraulic cylinder and piston coupled with the sucker rod string to raise and lower the sucker rod twice the distance of travel of the hydraulic cylinder.

It is another object of the invention to provide a new and improved form of tension member in a hydraulic well pump for connection with a sucker rod string over idler sheaves.

It is another object of the invention to provide a hydraulic well pump including a fluid pressure counterbalance system using a pneumatic or hydraulic accumulator.

It is another object of the invention to provide a hydraulic well pump using either fixed or variable volume pumps.

It is another object of the invention to provide a remote sensor for a hydraulic piston useful in a hydraulic well pump.

It is another object of the invention to provide a hydraulic well pump having an adjustable sucker rod stroke length.

It is another object of the invention to provide a hydraulic control valve mechanism for use with reciprocating cylinders and especially adapted to hydraulic well pumps for controlling the linear motion pattern of a hydraulic cylinder including acceleration, deceleration, and velocity.

In accordance with the invention there is provided a hydraulic well pump including a hydraulic cylinder assembly, a sheave assembly secured with and raised and lowered by the hydraulic cylinder, a tension member secured to a fixed anchor at one end and extending upwardly over the sheave assembly and downwardly having means at the second end for connection with a sucker rod string leading to a well pump plunger, and hydraulic power and control means for extending and retracting the hydraulic cylinder to raise and lower the second end of the tension member over twice the distance of travel of the hydraulic cylinder assembly. Further, in accordance with this invention the well pump includes a counter-balance system having an accumulator connected with intake of the hydraulic pump powering the system. The hydraulic cylinder is powered by fixed or variable volume pumps. A device is provided for sensing and controlling the stroke length of the hydraulic cylinder assembly. A valve device is also provided for controlling the linear motion pattern of the hydraulic cylinder assembly.

The details of specific embodiments of the invention and the foregoing objects and advantages will be better understood from the following description taken in conjunction with the accompanying drawings wherein:

FIG. 1 is a schematic view in section and elevation of one embodiment of a hydraulic well pump incorporating the features of the invention;

FIGS. 2A and 2B taken together form a schematic diagram of a hydraulic power and control system for operating the hydraulic well pump of FIG. 1;

Figure 10A:
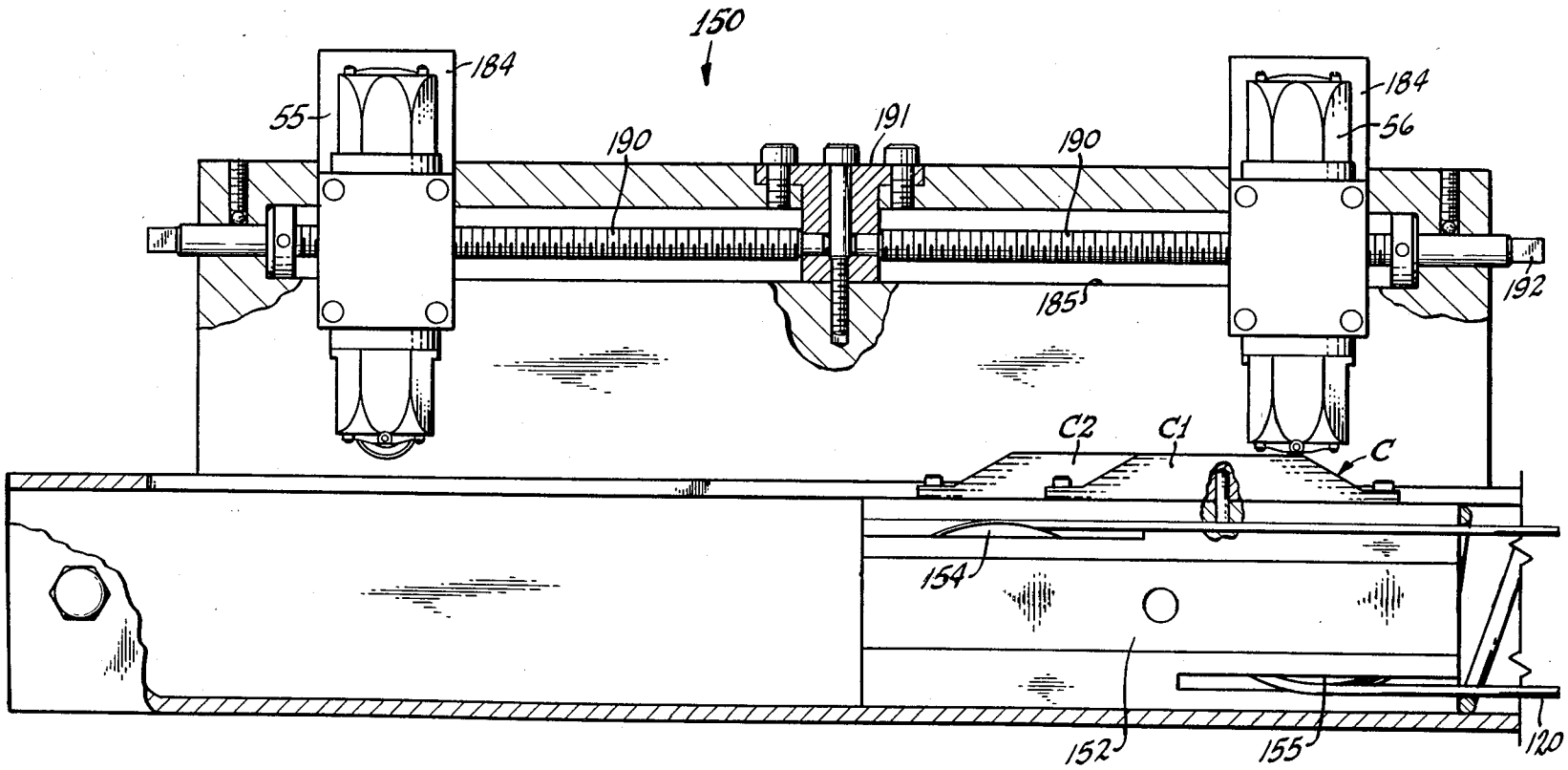
Figure 13:
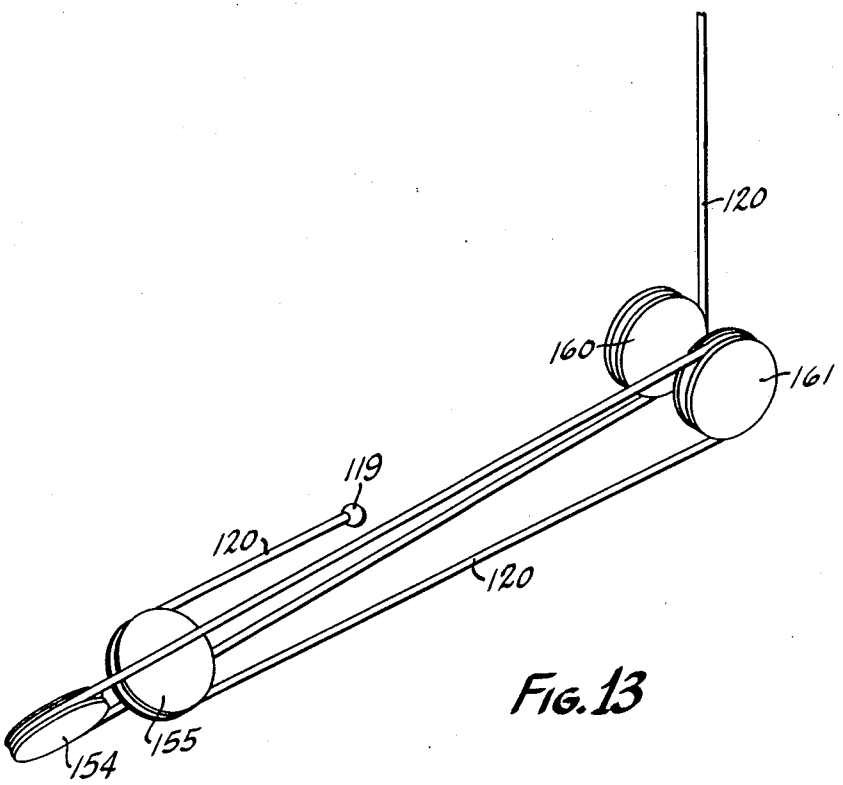
Figure 12:
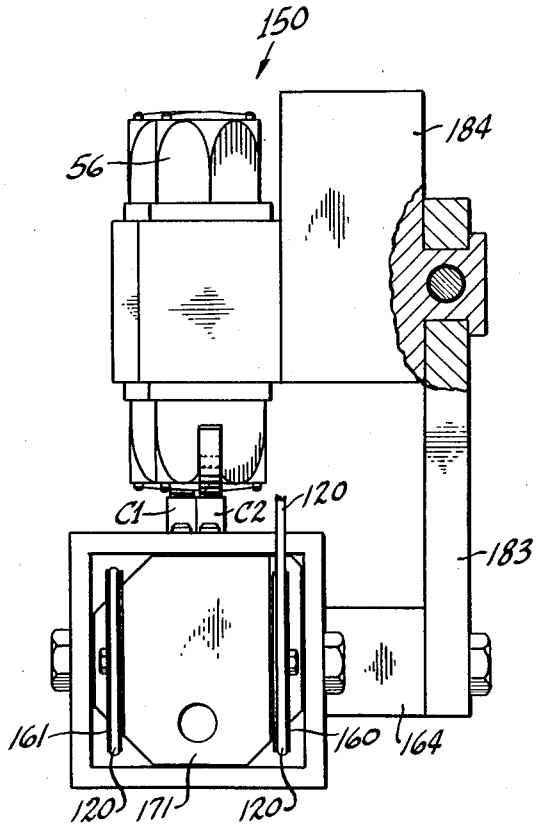
Figure 17:
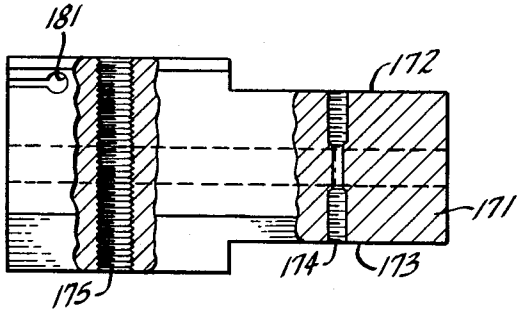
Figure 16:
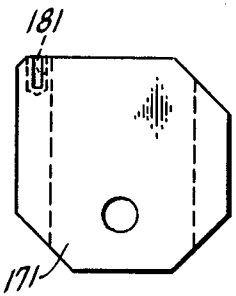
Figure 15:
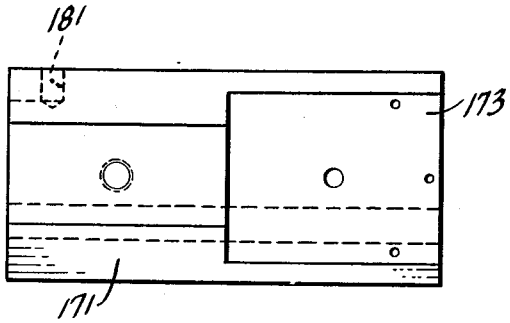
Figure 14:
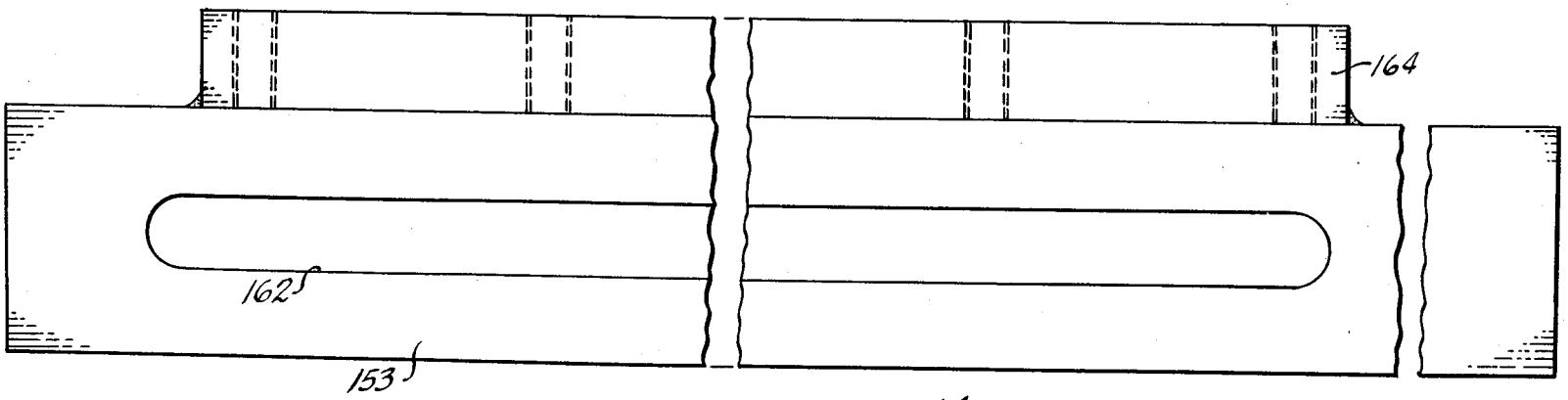
Figure 19:
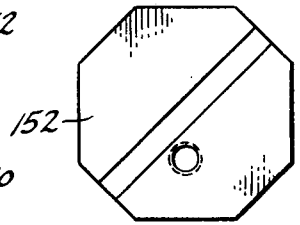
Figure 18:
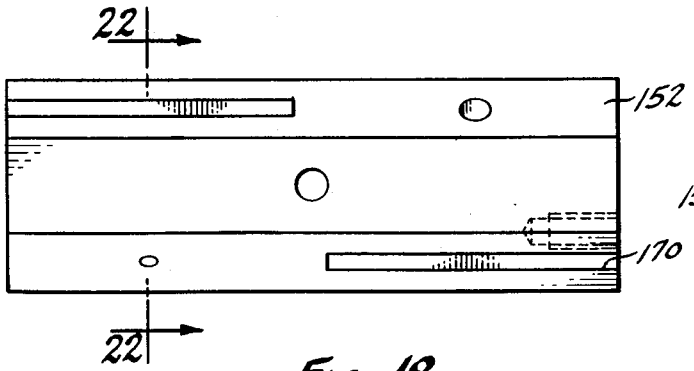

FIGS. 10A and 10B taken together form a view in section and elevation of the hydraulic cylinder stroke length sensor;

FIG. 11 is a fragmentary top view showing one of the cylinde limit valves of the sensor of FIGS. 10A and 10B;

FIG. 12 is a right end view in section and elevation of the sensor illustrated in FIGS. 10 and 10B;

FIG. 13 is a schematic view of the cable and sheave system of the sensor;

FIG. 14 is a top broken plan view of the sensor body;

FIG. 15 is a side view in elevation of the stationary sheave block of the sensor;

FIG. 16 is a left end view in elevation of the stationary block of FIG. 15;

FIG. 17 is a top view in elevation and section of the stationary block;

FIG. 18 is a side view in elevation of the traveling sheave block of the sensor;

FIG. 19 is a right end view in elevation of the traveling block of FIG. 18

Figure 22:
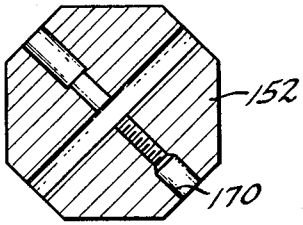
Figure 21:
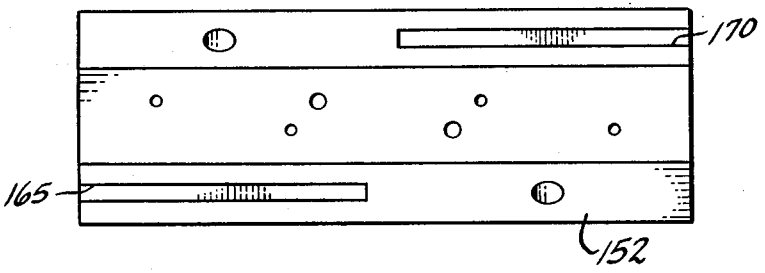
Figure 20:
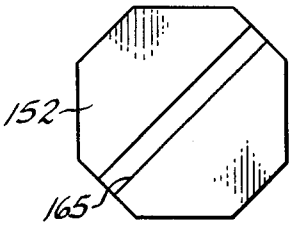
Figure 23:
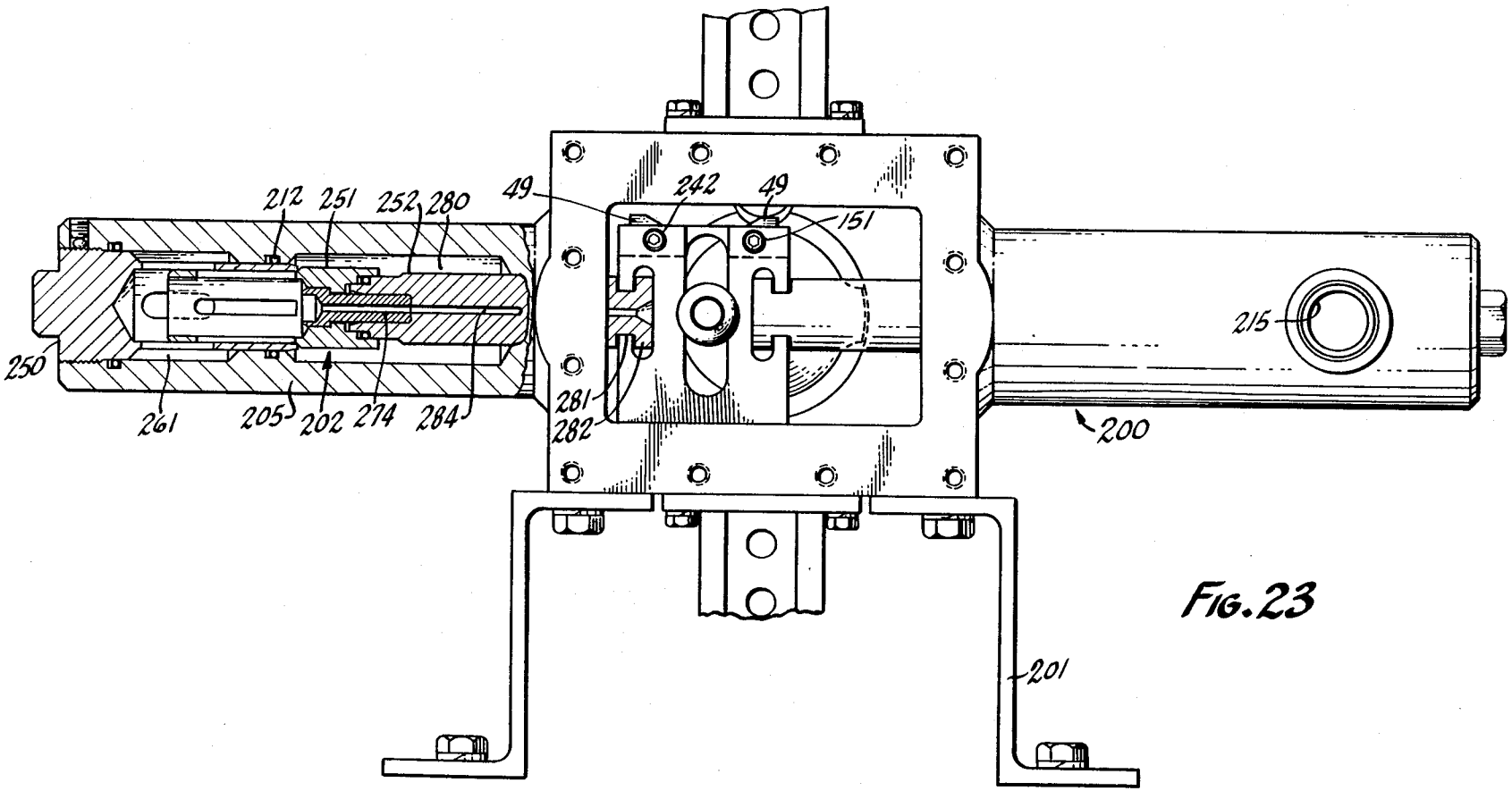
Figure 24:
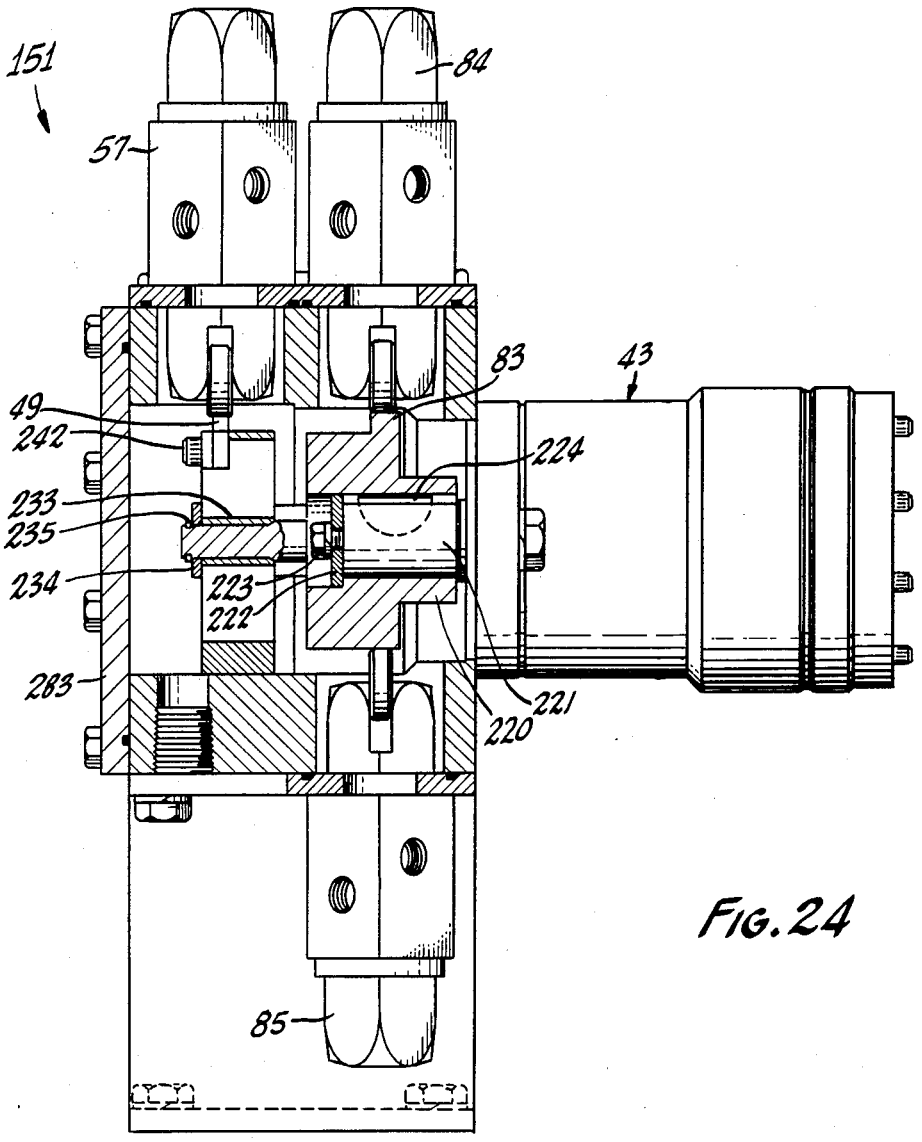
Figure 25:
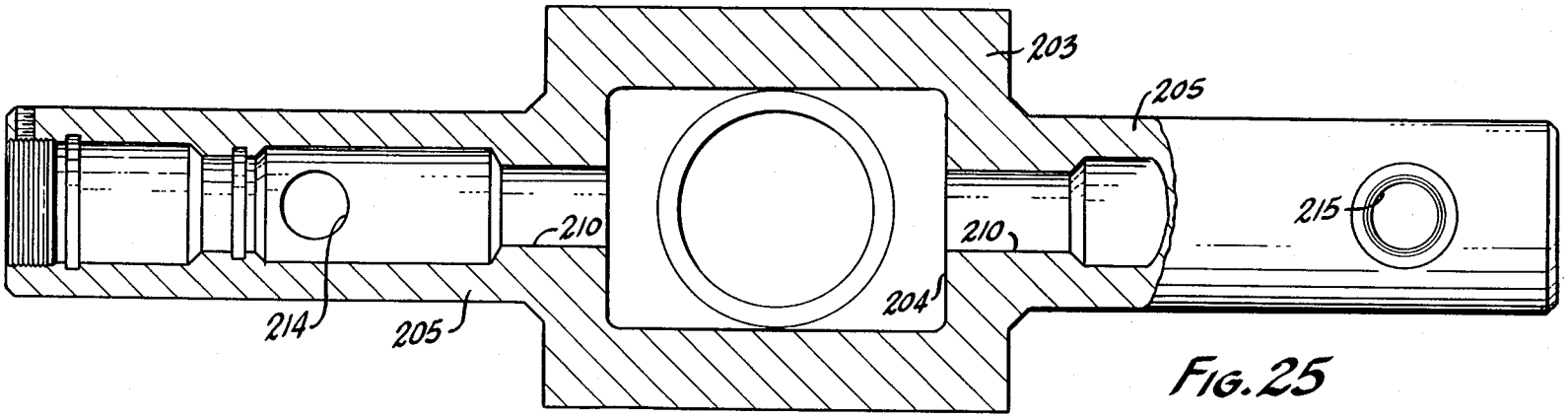
Figure 27:
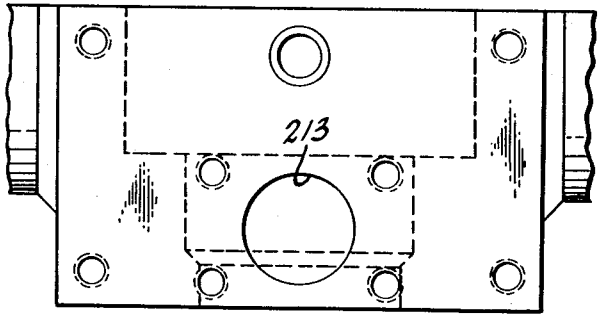
Figure 26:
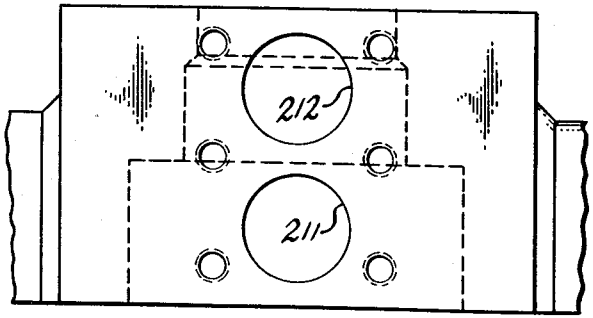
Figure 31:
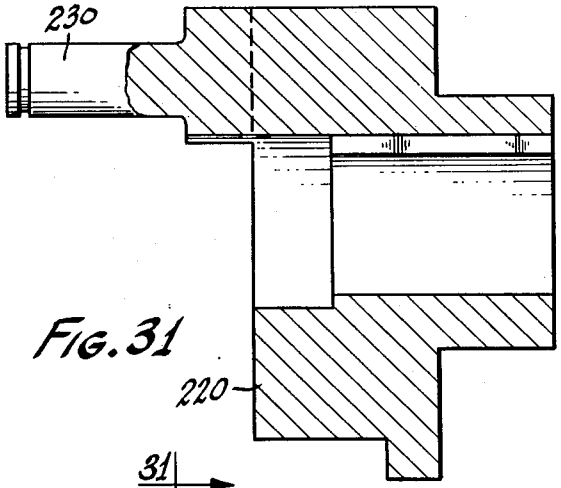
Figure 30:
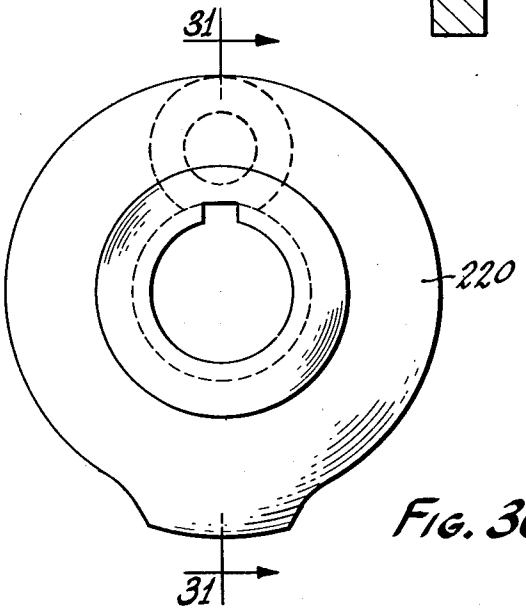
Figure 29:
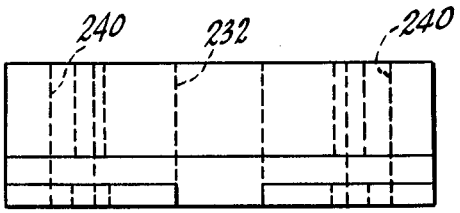
Figure 28:
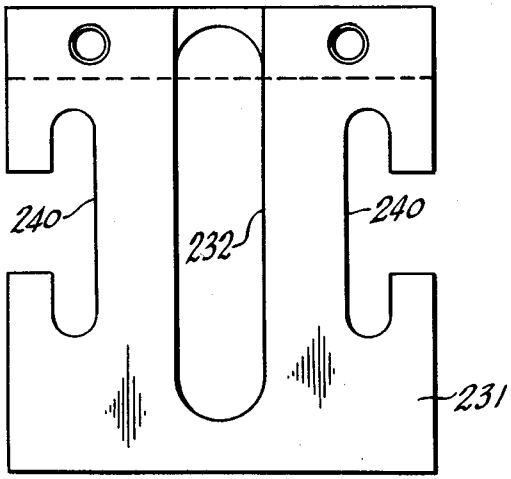
Figure 33:
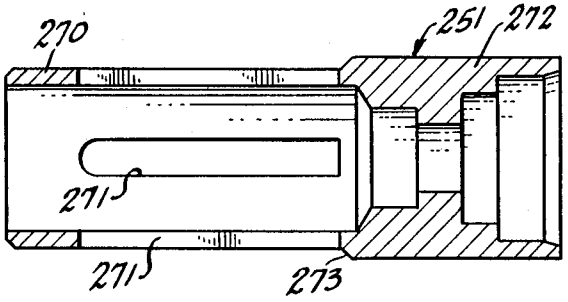
Figure 35:
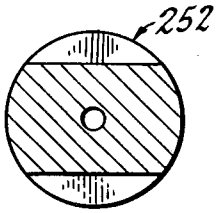
Figure 32:
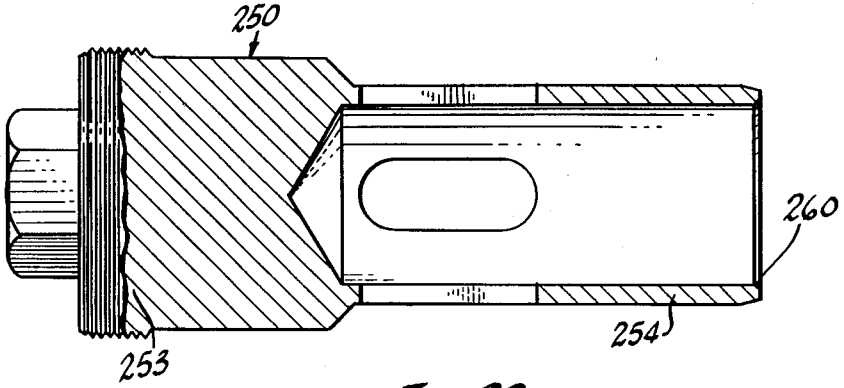
Figure 34:
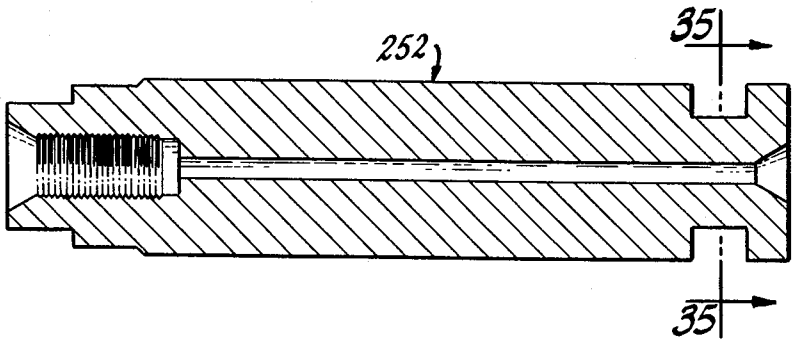

FIG. 20 is a left end view in elevation of the traveling block of FIG. 18;

FIG. 21 is a top plan view of the traveling block of FIG. 18;

FIG. 22 is a view in section of the traveling block along the line 22—22 of FIG. 18;

FIG. 23 is a view in section and elevation of the hydraulic cylinder linear motion control device;

FIG. 24 is a right end view in section and elevation of the device of FIG. 23;

FIG. 25 is a view in section and elevation of the valve body of the device of FIG. 23;

FIG. 26 is a fragmentary top plan view of the central portion of the valve body of FIG. 25;

FIG. 27 is a bottom fragmentary view of the valve body of FIG. 25;

FIG. 28 is a front view in elevation of the cross head of the motion control device of FIG. 23;

FIG. 29 is a top plan view of the cross head of FIG. 28;

FIG. 30 is a front view in elevation of the cam crank of the motion control device of FIG. 23;

FIG. 31 is a side view in section of the cam crank along the line 31—31 of FIG. 30;

FIG. 32 is a side view in section and elevation of one of the valve seats of the motion control device of FIG. 23;

FIG. 33 is a side view in section and elevation of one of the valves of the motion control device of FIG. 23;

FIG. 34 is a longitudinal side view in section of one of the valve spools of the motion control device of FIG. 23; and FIG. 35 is a view in section of the valve spool along the line 35—35 of FIG. 34.

Figure 1:
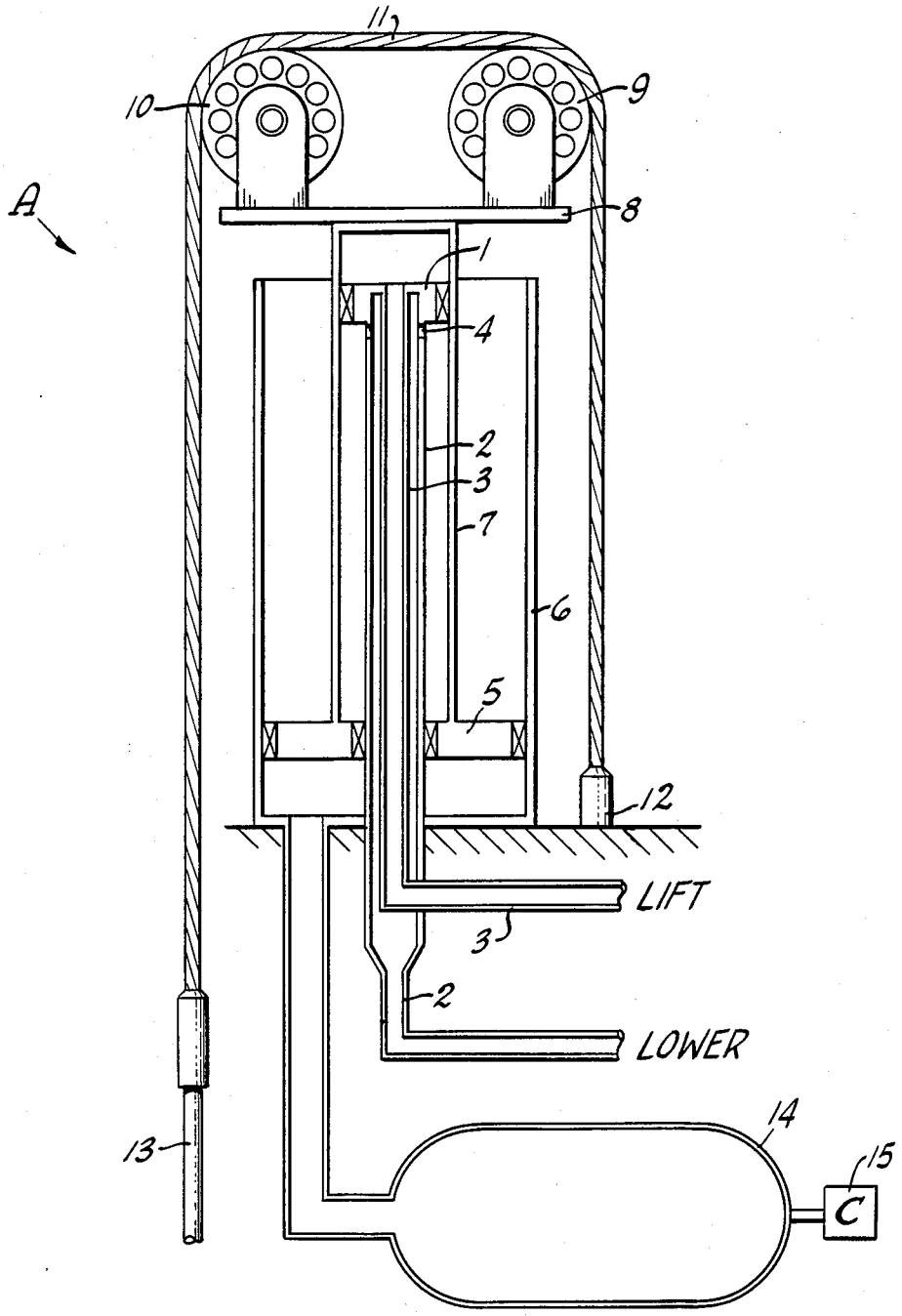

Referring to FIG. 1, a hydraulic well pump A embodying the features of the invention includes an air counterbalanced hydraulic cylinder assembly which operates a flexible tension member connected with a pump sucker rod raising and lowering the rod twice the distance of the lift of the hydraulic cylinder. The hydraulic cylinder assembly includes a stationary hydraulic piston 1 on the upper end of a hollow piston rod 2 mounted in coaxial spaced relation around a flow conductor 3. The piston rod has ports 4 below the piston 1 opening into the annular space between the piston rod 2 and the flow conductor 3. A counter-balance annular piston 5 is movable in sealed relationship along the piston rod 2 within a stationary cylinder 6 at the lower end of a hydraulic cylinder 7 which moves in sealed relationship along the stationary hydraulic piston 1. An idler sheave platform 8 is secured on the upper end of the movable cylinder 7. Idler sheaves 9 and 10 are mounted in horizontal spaced relation on the platform 8. A flexible tension member 11 is secured at one end 12 to the base or foundation for the hydraulic pump, extends over the sheaves 9 and 10 and downwardly connected at the other end with a well pump sucker rod string 13. A counter-balance air receiver 14 supplied with air from a compressor 15 communicates through a conduit with the stationary cylinder 6 below the piston 5 for applying a pneumatic force upwardly on the piston 5 substantially equal to the downward force produced by the combined weights of the movable components of the well pump including the polish rod string and the fluid column in the well above the pump plunger.

The hydraulic well pump A is operated by pumping hydraulic fluid through the conduit 3 into the movable hydraulic cylinder 7 above the piston 1 raising the platform 8 with the sheaves 9 and 10. Because the first end of the tension member 11 is secured at 12 the second end of the tension member connected with the sucker rod 13 is lifted twice the distance that the sheaves are raised. The free running end of the tension member moves at twice the rate of extension of the cylinder 7 with the platform 8 and the sheaves 9 and 10. The weight supported by the hydraulic cylinder assembly is equal to twice the weight supported by the sucker rod 13. That weight is also equal to the sum of the vertical force provided by the piston 5 and the vertical force provided by the upper or cap end of the cylinder 7. When the hydraulic cylinder is extended to the upper end of the stroke, the well pump is reversed by pumping hydraulic fluid into the movable cylinder 7 below the piston 1 through the annulus between the conduit 3 and the piston rod 2 and outwardly through the ports 4 below the piston 1. Thus the hydraulic well pump is reciprocated by alternately pumping the hydraulic cylinder assembly upwardly and downwardly. The pneumatic counter-balancing of the hydraulic well pump reduces the force required to reciprocate the pump to the sum of the force necessary to overcome mechanical and fluid friction in the pumping system and column of fluid being lifted and accelerate the mass of the fluid column and the components of the pump and sucker rod being moved. Of course as the pump moves downwardly, the total forces are reduced by the value attributable to the column of fluid above the plunger pump which of course is not lowered during the downward stroke The counter-balancing substantially reduces the forces required to operate the hydraulic well pump and the employment of the particular arrangement of the idler sheaves and flexible tension member provides a pump plunger and sucker rod stroke twice the length of the travel of the hydraulic piston assembly thereby cutting the height of the required structure to half of the conventional walking beam type pumping jack.

Figure 2A:
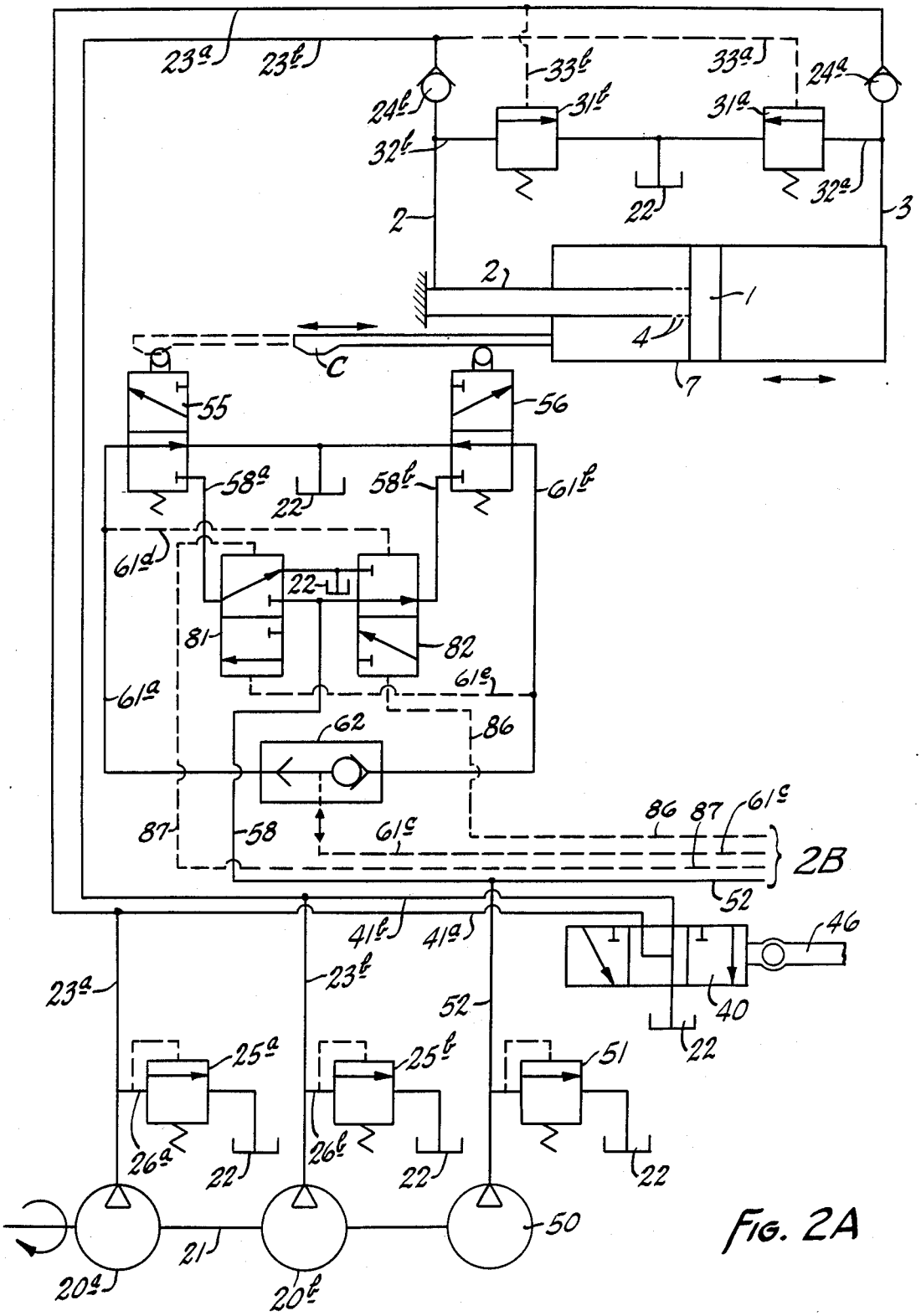
Figure 2B:
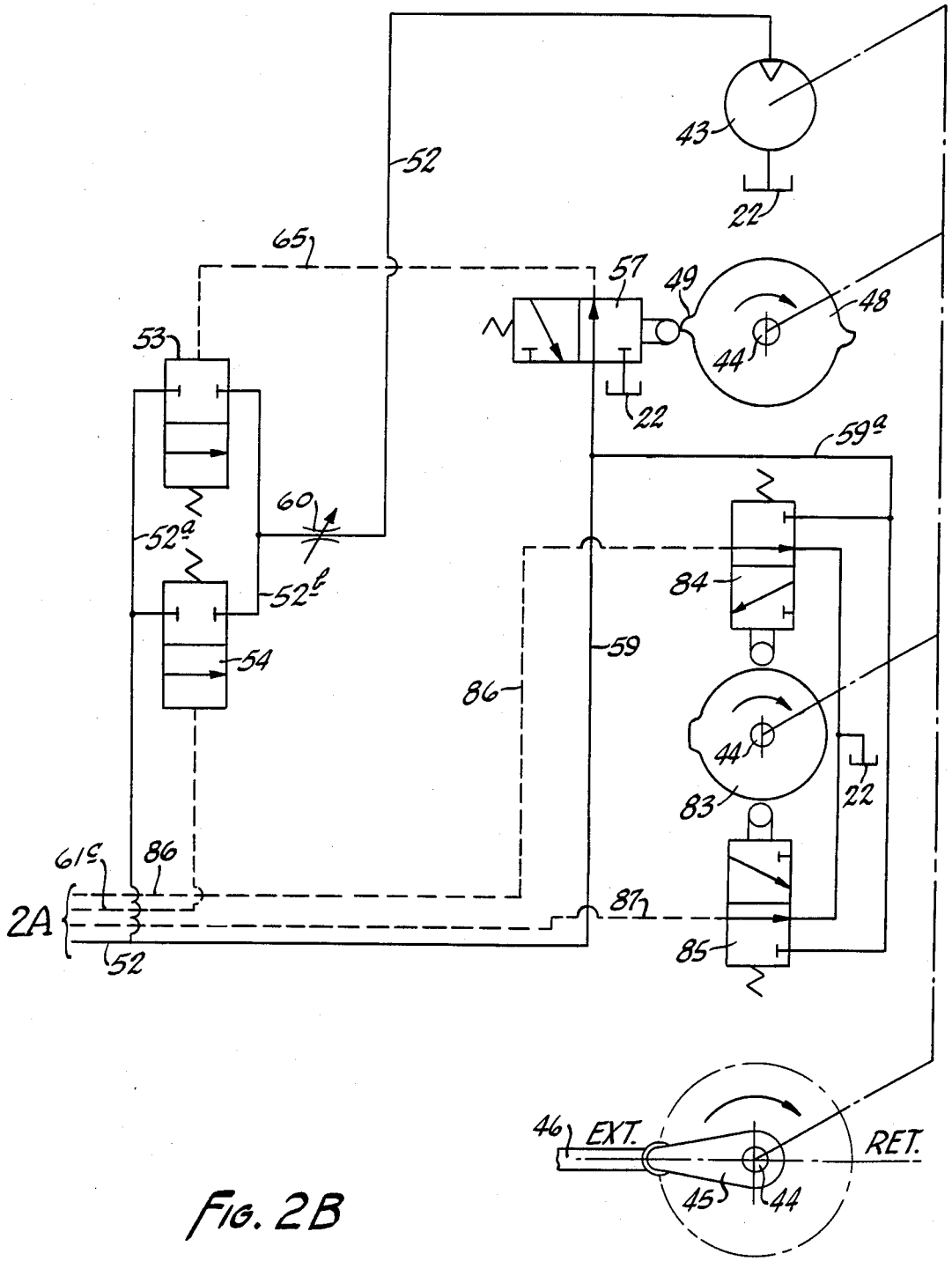

A hydraulic fluid power system which may be used to operate the well pump A of FIG. 1 is illustrated in FIGS. 2A and 2B. Referring to FIGS. 2A and 2B, only the hydraulic power and control circuitry is illustrated, it being understood that the reciprocating cylinder 7 which moves relative to the stationary piston 1 is connected at a lower end with the piston 5 operating in the outer cylinder 6 in response to the air counterbalance system schematically represented in FIG. 1. The same reference numerals are used in FIG. 2A to designate the corresponding parts of the hydraulic cylinder system as are used with such parts in FIG. 1, such for example, as the numeral 2 designates the hollow piston rod 2 with the flow conductor connected with the piston rod for supplying the hydraulic fluid which drives the movable cylinder 7 and thus the pump A downwardly. The power circuit for delivering hydraulic fluid to the hydraulic cylinder assembly includes two fixed volume pumps 20*a* and 20*b* each capable of delivering a desired volume and pressure for the particular function of the well pump. The pump 20*a* is associated with the cap end of the cylinder 7 while the pump 20*b* is associated with the piston rod end of the cylinder. Thus the pump 20*a* drives the well pump during the lift cycle and the pump 20*b* drives the well pump during the retract or lowering cycle. The two pumps 20*a* and 20*b* are coupled to and driven by a common drive shaft 21 and a single power source, not shown, which may be an electric motor or internal combusion engine. A hydraulic fluid reservoir 22 indicated schematically with respect to several returns in the system provides the source of hydraulic fluid for both of the pumps. The outlet of the pump 20*a* is connected to the cap end of the cylinder 7 by a line 23*a* including a check valve 24*a* permitting flow only in the direction into the cap end of the cylinder. A pressure relief valve 25*a* is connected in a line 26*a* leading from the line 23*a* and dumping into the tank 22. The relief valve 25*a* responds to pressure in the line 23*a* and opens to dump fluid to the tank when the maximum selected pressure of that line is reached. The valve 25*a* thus limits the maximum fluid pressure available to the cap end of the cylinder 7. The outlet of the pump 20*b* is connected with the rod end of the cylinder by the line 23*b* including the check valve 24*b* and the line and piston rod 2 defining the flow path into the rod end of the cylinder. Because the effective area of the piston rod in the cylinder is less than that of the cap end, the pump 20*b* may have different operating parameters from those of pump 20*a*. A pressure relief valve 25*b* is connected by the line 26*b* into the line 23*b* and to the tank 22 for dumping fluid back to the tank when a selected maximum pressure in the line 23*b* is reached.

As seen in FIG. 2A, the control system for the delivery of hydraulic power fluid to the pump cylinder includes sequence valves 31*a* and 31*b* associated respectively with the cap and rod ends of the cylinder 7. The sequence valves are connected as cross-piloted valves to prevent the overrun of the reciprocating cylinder in the event resistance to movement should reverse for some reason. The sequence valve 31*a* is connected between the line 23*a* and the tank 22 by a line 32*a*. The valve 31*b* is connected between the line 23*b* and the tank 22 by a line 32*b*. The valve 31*a* is connected to the line 23*b* by a pilot line 33*a* so that the valve 31*a* is opened in response to pressure in the rod end of the cylinder. The valve 31*b* is connected to the line 23*a* by a pilot line 33*b* so that the valve 31*b* operates in response to pressure in the cap end of the cylinder 7. It will be apparent that as the cylinder 7 reciprocates in each direction, the pressure within the cylinder on the opposite end must be relieved for the cylinder to move. Thus, the sequence valve 31*a* relieves the pressure in the cap end of the cylinder 7 as the cylinder retracts or moves down-downwardly; the sequence valve 31*b* relieves the pressure in the rod end of the cylinder as the cylinder extends or moves upwardly.

Direction control of the cylinder 7 is effected by control valve 40 connected between the outlets of the pumps 20*a* and 20*b* and the tank 22. The valve 40 may be any one of several types of valves including spool, plug, shear seal, double poppet, or rotary. The valve 40 is a three-position valve having an intermediate dump position in which the outlets of both of the pumps are communicated with the tank 22 effectively unloading both pumps. The valve 40 has extend and retract positions for fluid flow from each of the pumps to its respective end of the cylinder 7. For controlling flow to the cap end of the cylinder 7, the outlet of the pump 20*a* is connected through the line 41*a* to the valve 40. When the valve 40 is in the dump position for the cap end of the cylinder, the outlet of the pump 20*a* is dumped to the tank 22. The outlet of the pump 20*b* is connected with the valve 40 through the line 41*b*. When the valve 40 is in the dump position for the rod end of the cylinder 7, the outlet of the pump 20*b* is dumped through the valve 40 to the tank 22. To extend the cylinder 7 to the right as seen in FIG. 2A, lift the cylinder as viewed in FIG. 1, the valve 40 is shifted to the left as seen in FIG. 2A blocking the line 41*a* at the valve 40 while the line 41*b* remains open to dump fluid from the piston end of the cylinder back to the tank 22. The output from the pump 20*a* necessarily flows through the line 23*a*, the check valve 24*a*, and the line 3 into the cap end of the cylinder 7 thereby moving the cylinder 7 relative to the fixed piston 1. Similarly, to retract the cylinder 7 downwardly, to the left in FIG. 2A, the valve 40 is shifted to the right to block the line 41*b* while the line 41*a* is opened to the tank 22. Fluid from the pump 20*b* flows to the rod end of the cylinder 7 through the line 23*b*, the check valve 24*b*, and the flow passage 2 extending into and through the piston rod 2. The pressure in the line 23*b* acts through the pilot line 33*a* to the valve 31*a* opening the valve permitting flow from the cap end of the cylinder 7 through the line 32*a* and the valve 31*a* back to the tank 22. The acceleration or deceleration of the reciprocating cylinder 7 will be directly related to the manner in which the direction control valve 40 is shifted. With appropriate manipulation of the direction control valve, it is possible to cause the cylinder to emulate simple harmonic motion in the pattern of acceleration and deceleration. For both directions of the cylinder movement, the speed of movement will be proportional to the discharge rate of the particular pump driving the piston and the maximum force applied to the piston will be limited by the setting of the respective pressure relief valves.

The hydraulic system of FIGS. 2A and 2B includes mechanism provided to reciprocate the direction control valve 40 including a small rotary hydraulic motor 43 having an output shaft 44 driving a crank arm 45 non-rotatably fixed to the output shaft, FIG. 2B. A pitman arm or link 46 is connected between the crank arm and the reciprocating valve member of the valve 40 to shift the direction control valve. A rotary cam 48 having diametrically opposed external lobes 49 is also non-rotatably fixed to the motor shaft 44. A low pressure hydraulic pump 50 with an associated relief valve 51 provides pressurized fluid for driving the motor 43 and provides pilot fluid for operating certain pilot operated valves included in the hydraulic logic circuit and system of FIGS. 2A and 2B. The pump 50 may be driven by the drive shaft 21 also driving the pumps 20*a* and 20*b*. The pump 50 discharges to the motor 43 through a fluid line 52 which includes branches 52*a* and 52*b* including pilot operated, two-way stop and start valves 53 and 54. The valves 53 and 54 control intermittent flow of fluid from the pump 50 to the motor 43. The stop and start valves 53 and 54 are controlled by limit valves 55 and 56 and a cam operated stop pilot valve 57 operated by the rotary stop cam 48. A variable orifice 60 is provided in the line 52 between the stop and start valves to function as a speed control for the hydraulic motor 43. The limit valves 55 and 56 are actuated by a cam C secured and movable with the cylinder 7. The limit valve 55 is operated by the cam when the cylinder 7 reaches the limit of its retract stroke; the limit valve 56 is operated by the cam C when the cylinder 7 approaches the limit of its extend stroke. The stop pilot valve 57 is actuated by the lobes 49 on the stop cam 48 for blocking the fluid line 52 to stop the motor 43. Fluid under pressure is supplied to the limit valves 55 and 56 from the pump 50 through the line 58 and the branch lines 58*a* and 58*b*. Pressurized fluid is also supplied to the pilot valve 57 from the pump 50 through the lines 52 and 59. Pilot fluid is conducted from the limit valves 55 and 56 to the start valve 54 through the pilot lines 61*a*, 61*b*, the shuttle valve 62, and the pilot line 61*c*. Pilot fluid is conducted from the stop pilot valve 57 to the stop valve 53 through a pilot line 65. The stop valve 53 is normally opened passing fluid to the motor 43 and is closed by pilot fluid from the pilot valve 57 when actuated by one of the lobes 49 on the stop cam 48. The pilot valve 57 is normally closed communicating the pilot line 65 with the tank 22 allowing the stop valve 53 to shift to the normal open position. When the pilot valve 57 is engaged by one of the cam lobes 49 on the cam 48, the valve 57 is opened passing pilot fluid from the line 59 to the stop valve 53 closing the stop valve.

The pilot operated start valve 54 connected in the branch line 52*b* is normally closed and is opened by pilot fluid from either one of the limit valves 55 and 56 conducted through the pilot line 61*c* leading from the shuttle valve 62. The limit valves 55 and 56 are identical in structure and function. Fluid is supplied to the limit valves 55 and 56 from the pump 50 through the lines 52 and 58 and through the dump valves 81 and 82 associated, respectively, with limit valves 55 and 56. The dump valve 81 supplies fluid to the limit valve 55 through the line 58*a*; the dump valve 82 supplies fluid to the limit valve 56 through the line 58*b*. The dump valves are bi-stable pilot operated valves opened and closed by pilot fluid. When open the dump valves pass fluid from the line 58 to the lines 58*a* and 58*b* associated with the limit valves 55 and 56, respectively. When closed, the dump valves communicate the lines 58*a* and 58*b* with the tank 22 allowing the dumping of fluid from the lines 58*a* and 58*b*. Each of the dump valves 81 and 82 is opened to enable the limit valve associated with the dump valve to pass fluid when the limit valve is opened by the cam C. Referring to FIG. 2A, when the cam C is moving to the right, the dump valve 82 having been previously opened when the cam C engaged the limit valve 55 allowing flow of fluid through the line 61*a* to the shuttle valve 62. At this time pilot fluid is passed through the line 61*a* to open the dump valve 82 so that the valve 82 is preconditioned to allow fluids to pass through the limit valve 56 when that valve is engaged by the cam C at the extend stroke limit. Similarly, at that point, the dump valve 81 is preconditioned by fluid passing through the lines 61*e* to allow fluid to pass through the limit valve 55 at the retract stroke limit.

As illustrated in FIG. 2B, the system and logic circuitry for closing the dump valves includes a rotary release cam 83 and cam operated release valves 84 and 85. The cam 83 is mounted on and rotated by the shaft 44 of the motor 43 and driven in timed relation with the crank 45 and the stop cam 48. The valves 84 and 85 are spring biased two-way normally closed valves opened by the operator lobe on the cam 83. Pilot fluid is supplied to the valves 84 and 85 through the lines 52, 59, and 59*a*. The valve 84 is associated with the dump valve 82 through pilot fluid line 86. Similarly, the valve 85 is associated with the dump valve 81 through pilot fluid line 87.

Referring to FIG. 2B, the stop cam 48 and release cam 83 are timed so that when the motor 43 is started by the engagement of the cam C with the limit valve 56, the stop valve 53 is opened by disengagement of the cam lobe 49 from the stop pilot valve 57. The release valve 84 is opened by the cam 83 passing pilot fluid to the dump valve 82 which occurs before the opposite lobe 49 of the cam 48 re-engages the stop pilot valve 57. The passing of the pilot fluid in the line 86 to the valve 82 closes the valve 81 allowing the dumping of fluid from the line 58*b* to tank 22 permitting the start valve 54 to close. The start valve 54 is closed even though the limit valve 56 is still engaged by the cam C so that the motor 43 is stopped when the opposite lobe 49 of the stop cam 48 re-engages the stop pilot valve 57. The dump valve 82 will remain closed in the dump condition until pre-conditioned by the limit valve 55 at the retract stroke limit. With the operation of the motor 43 initiated by the limit valve 55 at the retract stroke limit, a similar operating cycle occurs with the lobe of release cam 83 operating the release valve 85 to deliver pilot fluid through the line 87 to the dump valve 81.

Briefly the operation of the hydraulic systems of FIGS. 2A and 2B is as follows. With the cylinder 7 moving to the right extending the cam C toward the limit valve 56, the dump valve 82 has been previously opened to supply fluid to the limit valve 56. When the cam C approaches the limit of the stroke engaging the limit valve 56, pilot fluid is passed to the start valve 54 opening that valve and starting the motor 43. Simultaneously, pilot fluid is passed to the dump valve 81 through the line 61*e* opening that valve for a subsequent operation. The motor 43 first disengages the stop cam lobe 49 from the stop pilot valve 57 closing the stop pilot valve 57 removing pilot pressure from the stop valve 53 which is then opened by the stop valve spring. Shortly thereafter the lobe of the release cam 83 engages the release valve 84 closing the dump valve 82. Fluid is dumped from the line 58*b* and the connecting lines allowing the start valve 54 to close. The motor 43 continues to operate until the opposite stop cam lobe 49 engages the stop pilot valve 57 opening the valve 57 thereby closing the valve 53 stopping the motor 43. At the end of the stroke to the left in FIG. 2*a* the cam C engages the limit valve 55. First, the start valve 54 is opened to start the motor 43 and simultaneously the dump valve 82 is opened for a succeeding operation. Again, the motor 43 first disengages a stop cam lobe from the stop pilot valve 57 followed by the engagement of the release valve 85 by the lobe of release cam 83. This closes the dump valve 81 to close the start valve 54 even though the limit valve 55 is held open by the cam C. When the cams 48 and 83 again reach the condition illustrated in FIG. 2B, the stop valve 53 is closed to stop the motor 43.

It will be recognized that the hydraulic power and logic system of FIGS. 2A and 2B as used to operate the well pump A of FIG. 1 functions independently of the counterbalance system including the air receiver 14 and the compressor 15 which supply air into the outer cylinder 6 below the base piston 5. As the well pump reciprocates to raise and lower the sucker rod string 13, the weight of the rod string and the reciprocating parts of the well pump is supported by the air supplied into the system beneath the piston 5. Thus, the hydraulic power system is relieved of this weight of such movable components, the sucker or polish rod string, and the fluid column in the well above the pump plunger during the upstroke. Thus the hydraulic system is primarily concerned with overcoming friction and accelerating and decelerating the movable masses involved in operating the pump A.

Figure 3:
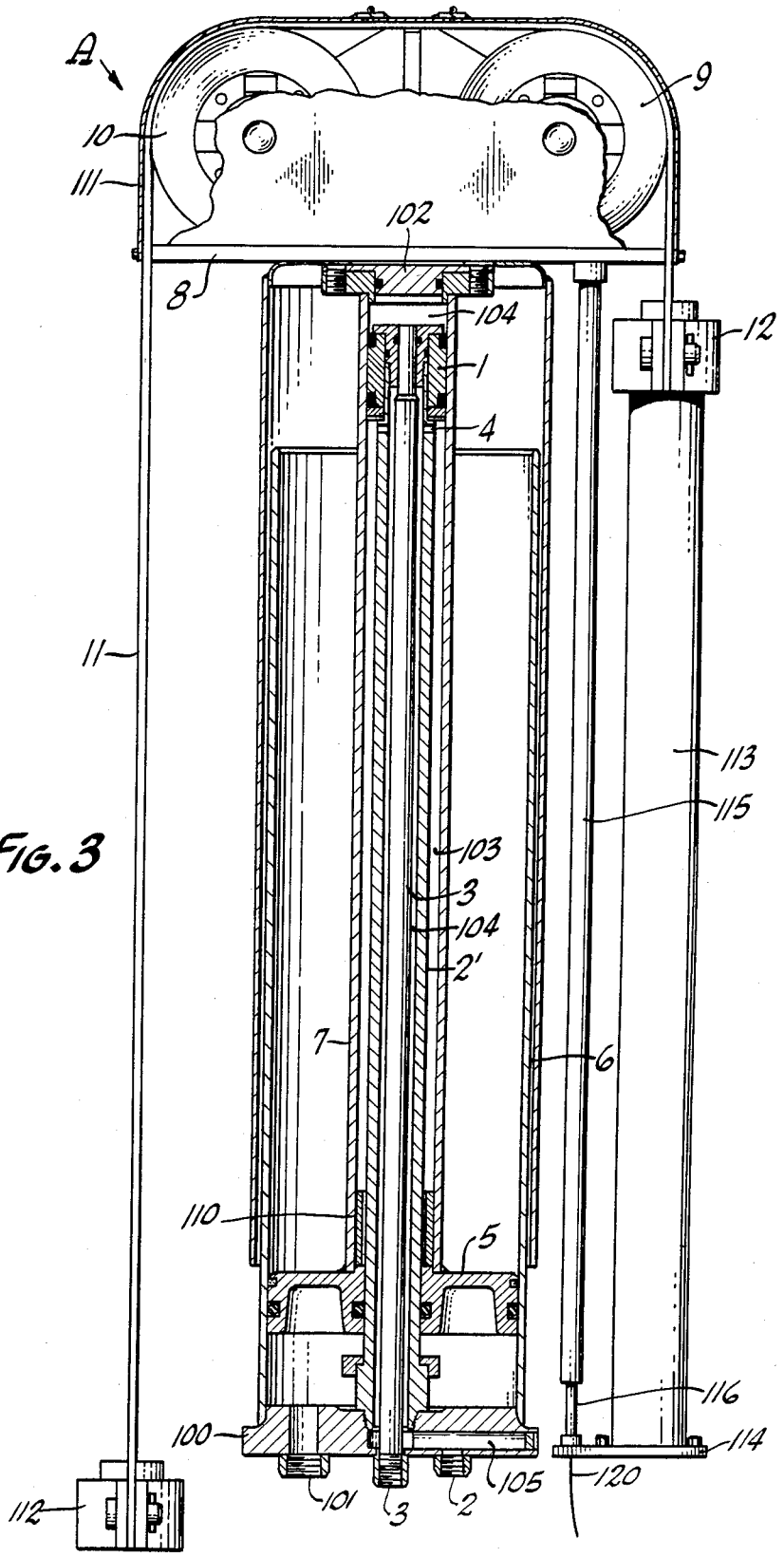
FIG. 3 is a side view in section and elevation of a specific embodiment of the hydraulic well pump of FIG. 1.
Figure 4:
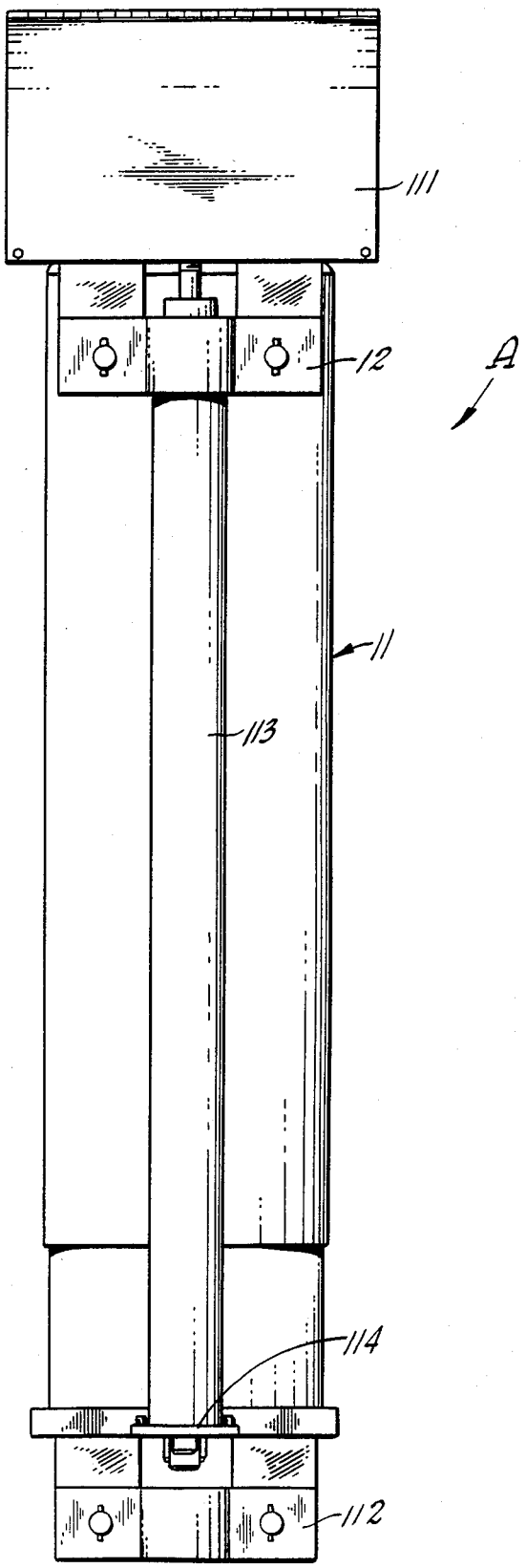
FIG. 4 is a broken back view in elevation of the hydraulic well pump of FIG. 3.
Figure 5:
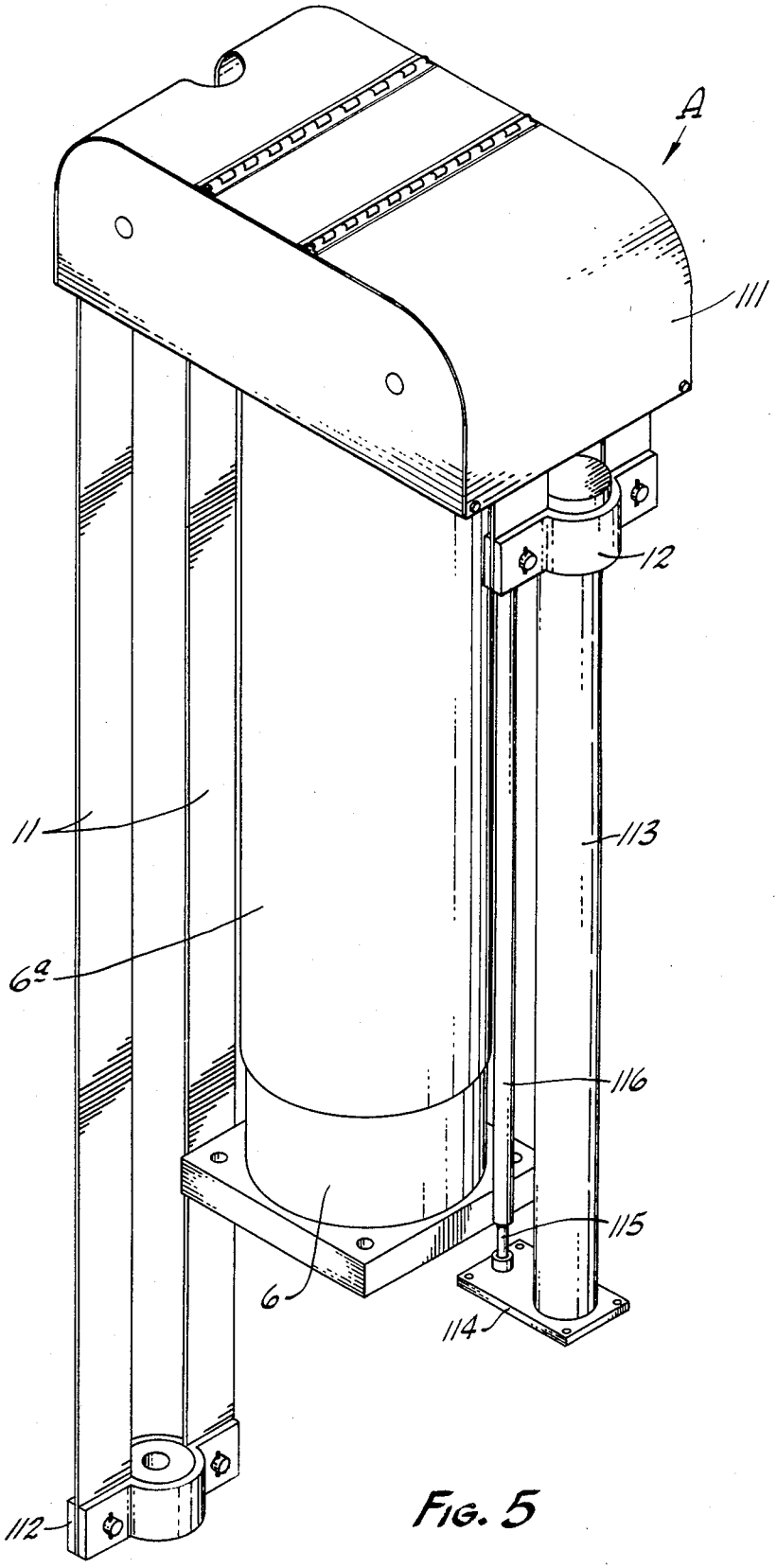
FIG. 5 is a view in perspective of the hydraulic well pump of FIGS. 3 and 4.

FIGS. 3, 4 and 5 show a specific preferred structural embodiment of the hydraulic well pump A shown in FIG. 1. Corresponding parts of the pump as shown in FIGS. 3–5 will be identified by the same reference numerals used in FIGS. 1 and 2A. Referring to the drawings, the stationary cylinder 6 is mounted on a base 100 provided with a flow coupling fitting 101 which admits counterbalance air from the receiver 14 and the compressor 15 into the cylinder 6 below the piston 5. The annular counterbalance piston 5 is secured on the lower end of the vertically movable inner cylinder 7 which connects in sealed relationship at the upper end thereof into a cylinder cap 102 connected on the bottom of the sheave platform 8. The inner movable cylinder 7 is mounted in concentric spaced relation over the fixed piston rod 2' which connects at the lower end thereof into the base 100. The counterbalance piston 5 slides in sealed relationship along the outer surface of the piston rod 2'. The upper end of the fixed piston 2' connects into the fixed piston 1. The inner surface of the movable cylinder 7 slides in sealed relationship along the outer surface of the piston 1. The upper end portion of the fixed piston rod 2' is provided with circumferentially spaced ports 4 below the piston 1 to admit hydraulic fluid into the annular space 103 between the piston rod 2' and the cylinder 7 for operating the well pump through its downward stroke. The flow conductor 3 connects through the base 100 extending in concentric spaced relation within the fixed piston rod 2' connecting at the upper end into the piston 1 for supplying hydraulic fluid into the chamber 104 above the piston 1 within the cylinder 7 for operating the well pump through the upward or extend stroke. The flow conductor 3 is spaced within the fixed piston rod 2' defining with the piston rod an annular flow channel 104 for fluid communication between the ports 4 and flow passage means 105 in the base 100 communicating with the flow passage 2 for the hydraulic fluid which operates the pump through the downward stroke. A stop tube 110 is mounted within the annular space 103 on the piston 5 limiting the upward movement of the movable cylinder 7 at the upper end of the upward stroke. The upper end edge of the stop tube 110 engages the lower end edge of the fixed piston 1. The sheaves 9 and 10 are mounted in rotatable spaced relation on the platform 8 within a removable protective cover 111. The flexible tension members 11 extend from fixed ends connected with the anchor 12 to the sucker rod coupling 112 on the movable end of the tension members. The anchor 12 is mounted on the upper end of an anchor post or standard 113 secured on a base 114. A telescoping cable cover formed by an inner sleeve 116 and an outer sleeve 115 is connected between the bottom face of the sheave platform 8 and the platform 114. The upper end of the outer tube is connected with the bottom of the platform 8 while the lower end of the inner tube is connected with the platform 114 so that the outer tube telescopes on the inner tube as the platform is raised and lowered during the strokes of the well pump. A cable 120 extends upwardly through the platform 114 through the inner and outer tubes connected at an upper end with the platform 8. As discussed in more detail hereinafter, the free end of the cable, not shown, extends to the hydraulic cylinder stroke length sensor shown in FIGS. 10A and 10B. The telescoping tube assembly protects that portion of the sensor cable 120 which runs between the platform 114 and the platform 8 during reciprocation of the well pump.

In accordance with the invention the flexible tension members 11 shown in FIGS. 3–5 are each a special multi-layer band or ribbon assembly each of which is composed of a number of very thin steel strips bonded together along each end portion of the assembly of the strips adjacent to the anchor 12 and the coupling 112. For example, one set of tension members 11 operated on a prototype of the hydraulic well pump A was formed by eight layers of steel strips each 10/1000 inch thick utilizing an epoxy bonding between the layers along the last several inches of each end portion of each strip. A very thin film lubricant was placed between the strips to provide lubrication enhancing the slip between the strips as the strip assembly moves over the sheaves. The layers forming the strip assemblies are held together in a 180° bend around a radius of the same dimension as the sheave radius of the well pump while the bonding procedure is performed. This assures that each of the layers of each strip assembly experiences the same stress when the layered tension member is subjected to normal operating tension over the idler sheaves 9 and 10. It will be apparent that as each layered tension member moves over the sheaves there is a difference in the distance traveled between the inner and outer members and thus slippage occurs between the layers. The film lubricant between the layers provides lubrication for the slippage between the layers. The use of the multiple layered tension members keeps the bending stresses low in each of the metal strips forming the members. It will be recognized that other tension members such as roller chains, single cables, and cables made up of multiple small cables may be used as tension members though the preferred form of multilayered tension members made up of the metal ribbons or strips provides superior performance. Cables tend to rapidly wear. A single cable requires much larger sheaves to minimize wear.

Figure 6:
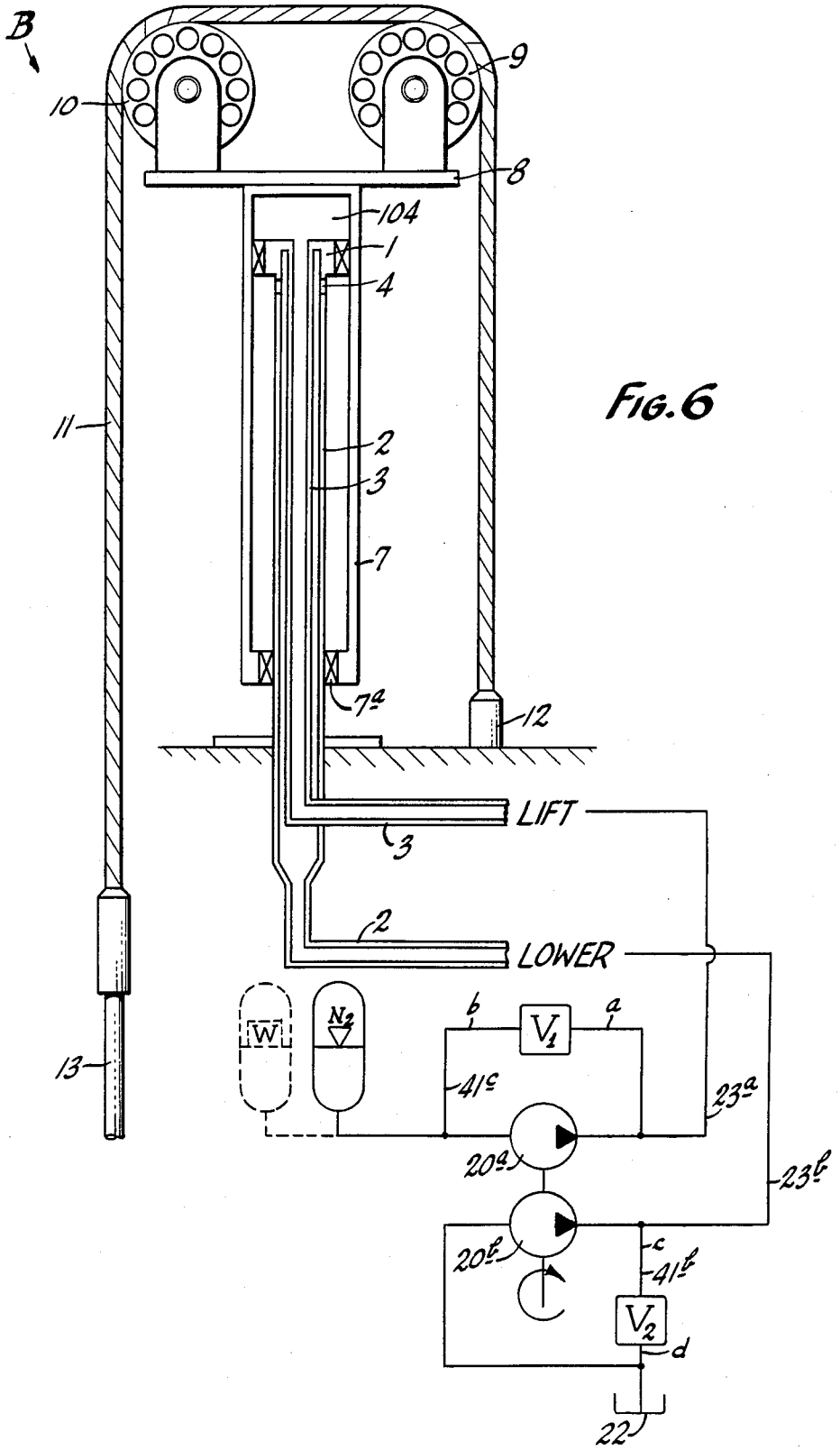
FIG. 6 is a schematic side view in section and elevation of another form of hydraulic well pump embodying the features of the invention.
Figure 7:
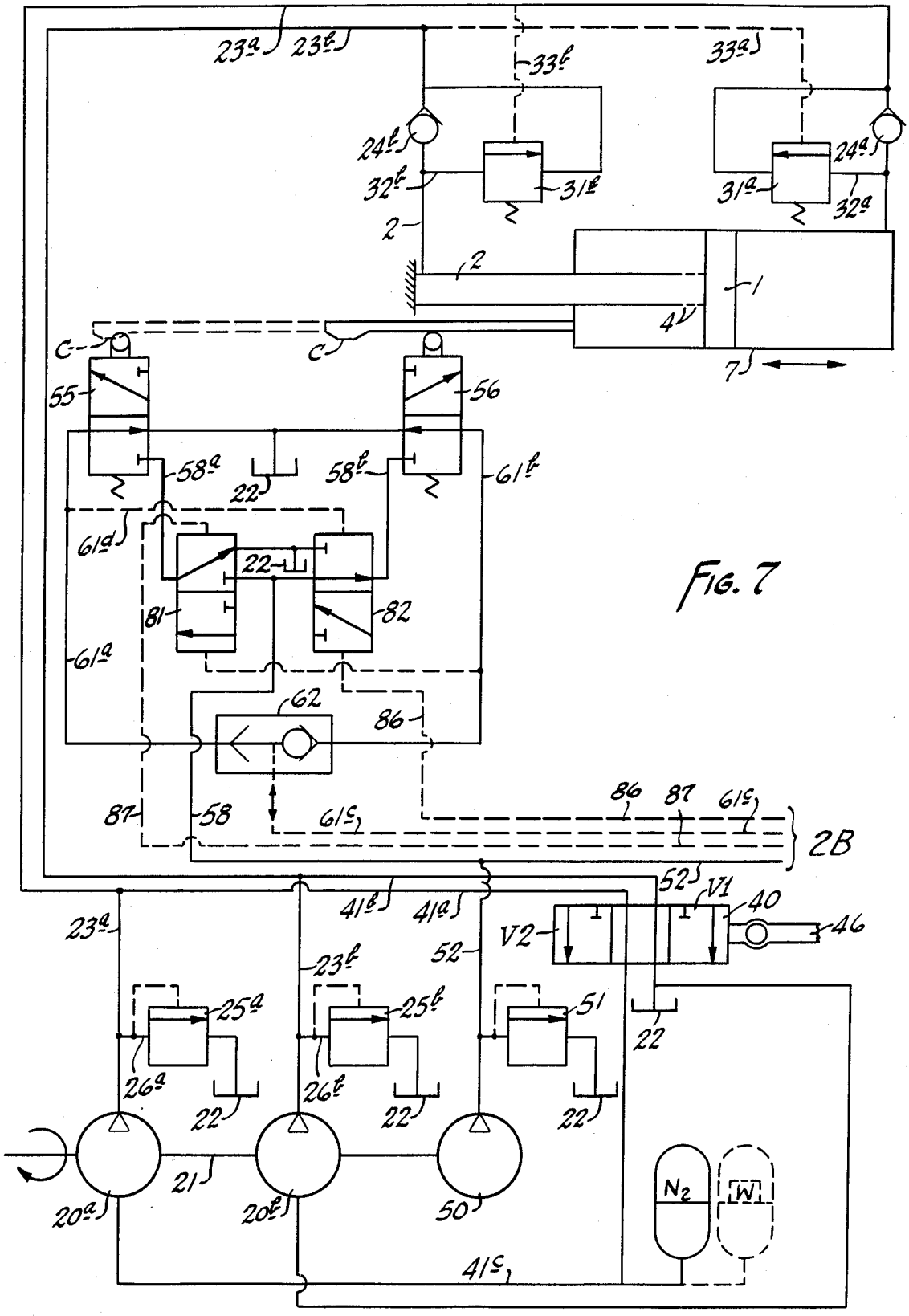
FIG. 7 is a schematic diagram of components of a hydraulic power system which in combination with the components of the fluid system of FIG. 2B may be used to operate the hydraulic pump of FIG. 6.

Referring to FIG. 6, the hydraulic well pump B illustrated schematically is a variation of the pump A shown in FIG. 1 wherein the only force supporting the pump load is contributed by the hydraulic cylinder. Counterbalancing is achieved by hydraulically supercharging the hydraulic pump supplying the pressure for lifting the sucker rod string. In FIG. 6 those parts corresponding with similar parts of the pump A in FIG. 1 will be referred to by the same reference numerals as used in FIG. 1. The well pump B primarily differs from the well pump A by the elimination of the counterbalance piston 5 because the counterbalancing is obtained by supercharging the pump supplying the hydraulic pressure for the lift stroke. The lower end of the movable cylinder 7 is closed in sliding sealed relationship with the fixed piston 2 by the annular closure cap 7*a*. In the well pump B the hydraulic pump 20*a* is supercharged by a gas charged hydraulic accumulator N2 or a dead weight activated hydraulic accumulator W either of which is connected with the intake side of the pump 20*a* as shown in FIG. 6. The hydraulic power and logic circuitry of FIGS. 7 and 2B taken together may be used to operate the well pump B. The portion of the system shown in FIG. 2B is exactly the same as that portion of the system described in connection with the operation of the well pump A. The portion of the circuitry shown in FIG. 7 differs only in the inclusion of the hydraulic accumulators. Referring back to FIGS. 6 and 7, the notations V1 and V2 as used in FIG. 6 designate the right and left sides, respectively, of the reversing valve 40 shown in FIG. 7. Referring to FIG. 6, during the lift stroke of the well pump B, hydraulic fluid pressure is supplied by the pump 20*a* through the line 23*a* into the conduit 3 raising the pressure in the chamber 104 above the piston 1 lifting the movable cylinder 7. The reversing valve side V1 is closed forcing the pressure in the accumulator W or N2 , which ever is being used, to supply supercharging pressure into the intake of the pump 20*a* thereby enhancing the lift of the pump. Hydraulic fluid below the piston 1 returns as the cylinder 7 is raised through the flow channel 2 along the line 23*b* and through the open reversing cylinder side V2 back to the tank 22. During the downstroke of the well pump B the reversing valve side V2 is closed whereby the output pressure from the pump 20*b* must flow through the line 23*b* into the flow passages 2 and outwardly through the ports 4 into the cylinder 7 below the piston 1 forcing the movable cylinder 7 downwardly. During the downward stroke the reversing valve side V1 is open permitting counterbalancing hydraulic fluid pressure to be effective from either the accumulator W or in the accumulator N2 along the line 41*c*, the line 23*a*, and the flow conductor 3 into the cylinder chamber 104 above the piston 1 which opposes the downward movement of the cylinder 7. The hydraulic power fluid and logic circuitry of FIGS. 7 and 2*a* taken together operate the hydraulic well pump B in exactly the same manner as previously described with respect to the system of FIGS. 2A and 2B in operating the well pump A. Looking at FIG. 7, when the reversing valve 40 is shifted to the left communication between lines 41*a* and 41*c* is closed while the line 41*b* is opened to the tank 22. In this mode of operation the flow from the accumulators W or N2 can only pass to the intake of the pump 20*a* which discharges into the line 23*a* flowing to the cap end of the cylinder 7 for operating the pump in the upstroke. The pump 20*a* is thus supercharged from one of the hydraulic accumulators. During the downstroke the valve 40 is shifted to the right closing off flow in the line 41*b* to the tank. The pump 20*b* discharges into the line 23*b* pumping the cylinder 7 downwardly while the hydraulic accumulator W or N2 is communicated to the line 41*a* applying the pressure from the accumulator from the line 23*a* into the cap end of the cylinder 7. With the exception of the hydraulic accumulators, the remainder of the power and logic circuitry for the hydraulic well pump B as illustrated in FIGS. 7 and 2B taken together operates exactly as previously described in connection with the well pump A.

Figure 8:
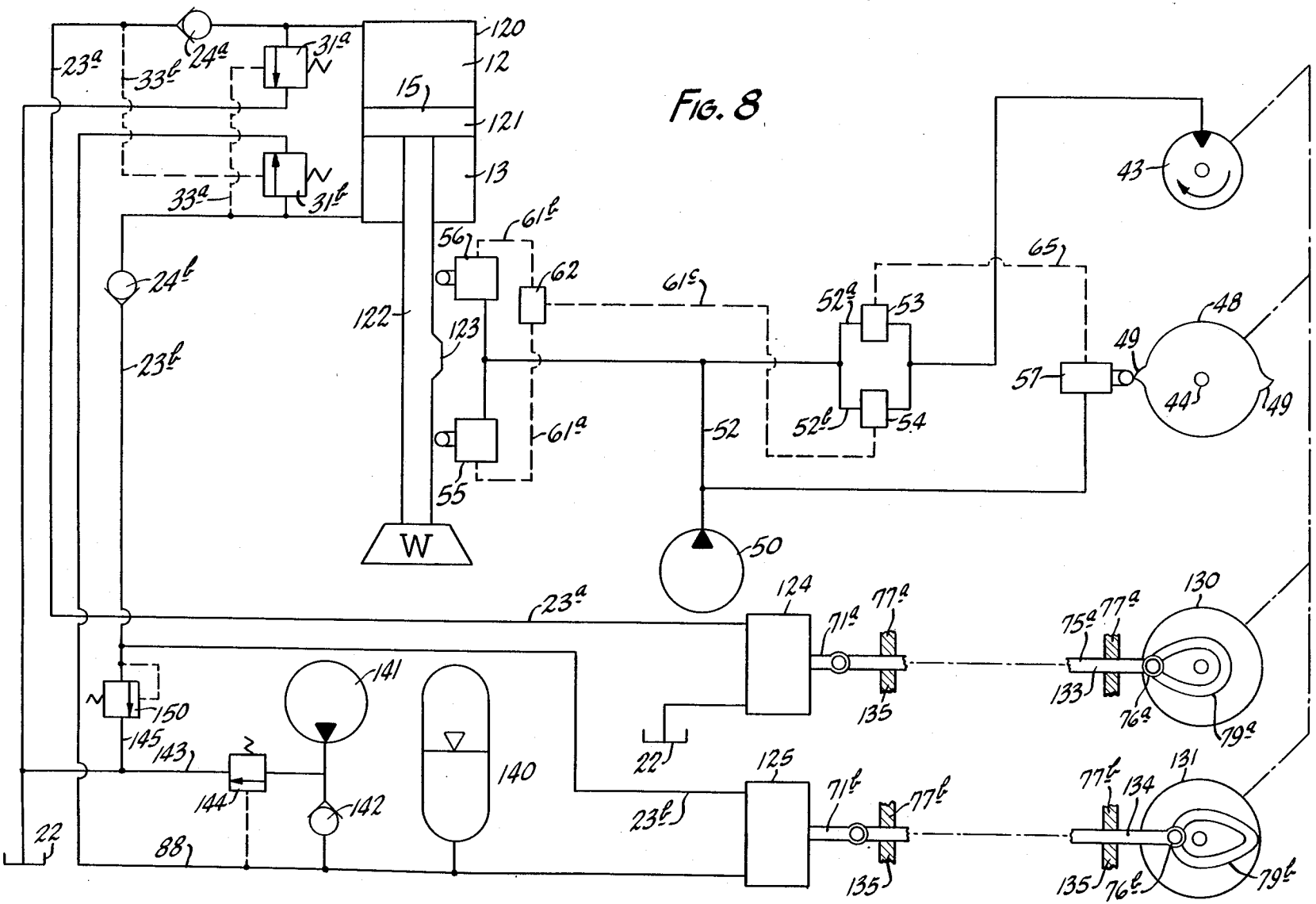
FIG. 8 is another form of hydraulic fluid and power system which may be used to operate the hydraulic pump of FIG. 6.

A still further form of hydraulic power and logic circuitry employing hydraulic counterbalance is schematically illustrated in FIG. 8. Those components of the system of FIG. 8 which are similar in structure and function to the components of the previously described system are identified by the same reference numerals as previously used. Referring to FIG. 8, the hydraulic cylinder system includes a cylinder 120, piston 121, an a piston rod 122. A weight W supported on the piston rod may be a well pump sucker rod string. A cam 123 on the piston rod is engageable with the limit valves 55 and 56 within the logic circuitry of the system. The system is powered by two variable volume hydraulic pumps 124 and 125 which discharge to the head and piston rod end of the cylinder respectively. The pumps are controlled by cams 130 and 131 which are driven on a common shaft with the cam 48 driven by the hydraulic motor 43. The cams are connected with the pumps through suitable links 133 and 134 respectively which operate through suitable bearings 135. A hydraulic counterbalancing accumulator 140 is connected into the suction side of pump 125. A makeup pump 141 also is connected into the suction side of the pump 125. The makeup pump 141 discharges into the suction line of pump 125 through a check valve 142. A line 143 including a pilot operated valve 144 also leads from the discharge of the pump 141 to the tank 22 and to the sequence valve 31a. A line 145 leads from the line 143 downstream from the valve 144 into the line 23*b* including a valve 150 pilot operated by the pressure in the line 23*b*. The cams 130 and 131 are configured to allow only one of the pumps 124 or 125 to deliver fluid to the cylinder 120 at any one time. The accumulator 140 supercharges the suction of the pump 125 to serve as a counterbalance against the weight W so that the only work required of the pump is to overcome friction and that portion of the cylinder stroke which might be under counterbalanced. When pumping down the return fluid below the piston 121 passes through the valve 31*b* and line 88 to the accumulator providing counterbalancing.

Figure 9:
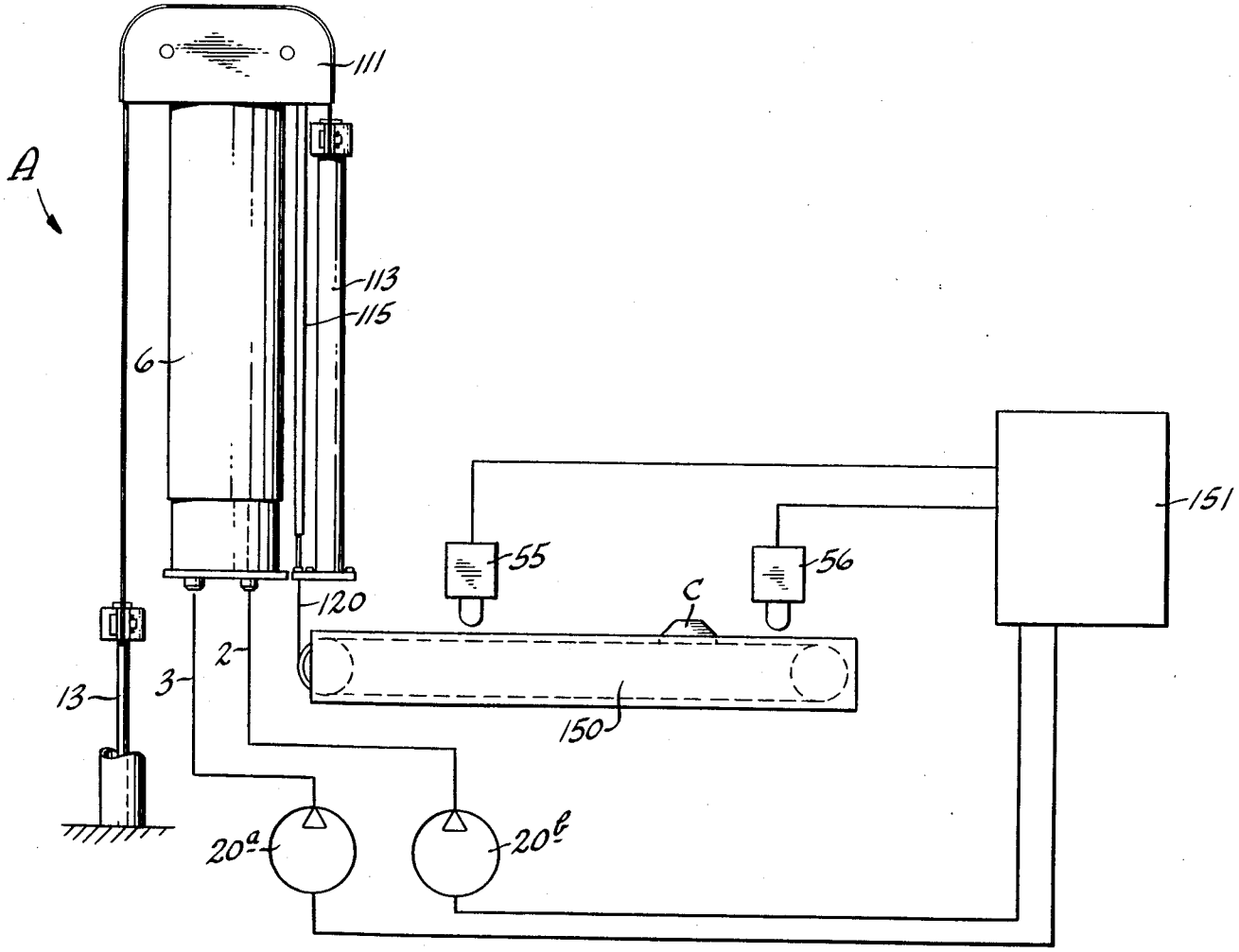
FIG. 9 is a schematic view of a hydraulic well pump in accordance with the invention including devices for sensing and controlling the pump stroke length and a device for controlling the linear motion of the hydraulic cylinder.

FIG. 9 illustrates schematically the hydraulic well pump A coupled with a pump stroke length sensor and controller 150 and a logic device 151 for controlling the linear motion of the hydraulic cylinder of the pump. The device 150 is illustrated in detail in FIGS. 10A, 10B and 11–22 inclusive. The device 151 is illustrated in FIGS. 23–35. It is to be understood that the devices 150 and 151 are illustrative of systems which may be employed to control the length of the stroke of the hydraulic pump and the character of motion during each stroke though it will be recognized that other forms of control apparatus may be used to accomplish the same functions.

Referring to FIGS. 10A, 10B, and 11–13, the device 150 includes structure for mounting the limit valves 55 and 56 and the operating cam C for the valves in a protected remote location from the hydraulic cylinder structure of the well pump. The only physical connection required between the device 150 and the hydraulic cylinder assembly is the operating cable 120 which extend between the hydraulic cylinder assembly and the sensor device 150. The device 150 simulates the cylinder movement shifting the cam C between the limit valves 55 and 56.

The sensor device 150 includes a traveling sheave block supporting the cam C and moving in a housing 153 between the valves 55 and 56. The cable 120 is reeved over a pair of sheaves 154 and 155 carried by the traveling block and fixed sheaves 160 and 161 in the housing as shown in FIG. 13. As evident from FIGS. 10A, 10B, 12 and 14, the housing 153 is a hollow square elongated member having an elongated top slot 162 along which the cam C is moved between the valves 55 and 56. A rectangular elongated spacer bar 164 is secured on the back face of the housing as seen in FIG. 14. The sheaves 154 and 155 are rotatably mounted in the traveling block 152 shown in detail in FIGS. 18–22. The sheaves are mounted in two slots which open through the opposite ends of the traveling block aligned at 90° angles with respect to each other. The sheave 154 is mounted in a slot 165, FIG. 20, opening upwardly and downwardly into the left end of the block 152 as viewed in FIGS. 10A and 18. The sheave 154 is supported on a shaft, not shown, extending through a hole 170, FIG. 22, intersecting the slot 165 at a 90° angle. Similarly the sheave 155 is mounted in a slot 170 opening through the top and bottom and opposite end of the traveling block as shown in FIGS. 18 and 19. The octagon shape of the traveling block permits the block to slide within the housing and sufficient portions of the sheaves to project beyond the block to carry the cable on the sheaves within the housing. The sheaves 160 and 161 are mounted on a stationary block 171 secured in the right end of the housing 153 as seen in FIGS. 10B and 12. The stationary block is shown in detail in FIGS. 15–17. The sheaves 160 and 161 are rotatably mounted in vertical slots 172 and 173 along opposite sides of the stationary block. The stationary block has an internally threaded horizontal bore 174 opening at opposite ends to the slots 171 and 172 for the mounting shafts, not shown, on which the sheaves 160 and 161 are rotatably supported. The stationary block also has a horizontal internally threaded bore 175 for a bolt and nut assembly 180, FIGS. 10B and 12, securing the stationary block in the right end of the housing as seen in FIG. 10B. A locking recess 181 is provided in the stationary block comprising a cylindrical recess portion which opens to a longitudinal recess opening through the top and end of the stationary block opposite where the sheaves 160 and 161 are mounted. The recess 181 receives an anchor ball 119 secured on the fixed end of the cable 120 for anchoring the cable end with the stationary block. The cable is reeved over the sheaves as shown in FIG. 13 with the cable passing off of the sheave 160 to the movable end of the cable connected with the platform 8 of the hydraulic well pump. A coil spring 182 is compressed in the housing between the stationary block 171 and the traveling block 152 for urging the traveling block away from the stationary block. Since the fixed end of the cable is anchored to the stationary block, when the cable is pulled by upward movement of the well pump platform 8, the traveling block is pulled toward the stationary block against the spring. When the well pump platform moves downwardly the cable is moved toward the sensor allowing the spring 182 to expand forcing the traveling block along the housing away from the stationary block moving the cam C toward the valve 55. In the particular embodiment of the sensor illustrated the cam C comprises two cam members C1 and C2 independently mounted in side-by-side relationship on the top of the traveling block so that the cams extend through and are movable along the slot 162 in the top of the housing 153. One of the cam members operates one of the valves 55 and 56 while the other cam member operates the other limit valve.

As evident in FIGS. 10A, 10B, 11 and 12, the limit valves 55 and 56 are supported from a vertical mounting plate 183 secured to the bar 164 along the back of the housing 153. The limit valves are movably mounted over the line of travel of the cam members C1 and C2 with one of the valves being aligned with one of the cam members and the other valve aligned with the other of the cam members. Each of the limit valves is secured with a valve manifold 184 which provides fluid communication to the valve and a mounting for the valve. The valve manifolds 184 are slidable horizontally along a slot 185 in the mounting plate. Identical threaded adjusting bars 190 extend along the slot 185 through an internal threaded bore of the valve manifold so that when the adjusting bar 190 is turned the limit valve associated with the adjusting bars is moved horizontally. The inward ends of the adjusting bars 190 have bearing portions mounted in a central retainer 191. The outward end portions of the adjusting bars 190 have flat surfaces 192 for engagement of a wrench to rotate the bar for adjusting the longitudinal position of the limit valve associated with the bar. As seen in FIG. 11 the limit valve 55 is secured with a spacer plate 193 which aligns the valve 55 slightly forward of the valve 56 so that the valve 55 is in alignment with the front cam member C1 while the valve 56 is aligned with the rear cam member C2. The valves 55 and 56 are independently movable longitudinally so that both the length of the hydraulic pump stroke and the upper and lower limit of the stroke are adjustable. The movement of the cam members exactly simulates the movement of the well pump platform 8 which is one-half of the full stroke of the pump. Since the only physical connection between the hydraulic cylinder assembly of the well pump and the sensor device 150 is through the cable 120, the sensor device may be housed separately at a location remote from the hydraulic cylinder assembly which is of course at the wellhead for raising and lowering the pump sucker rod string.

The control valve device or mechanism 151 illustrated in FIGS. 23–35 provides the operation requirements of the following components of the hydraulic power and logic system shown in FIGS. 2A and 2B: valve 40; coupling 46; crank arm 45; valve 85; cam 83; valve 84; valve 57; cam 48 with the cam lobes 49; and the logic drive motor 43. Utilizing the control valve mechanism 151, it is to be understood that the other components of the system of FIGS. 2A and 2B are connected with the control valve mechanism.

Referring to FIGS. 23 and 24, the valve control mechanism 151 includes a body 200 mounted on a bracket 201. The hydraulic drive motor 43 is secured to the back of the body. The valves 57 and 84 are mounted on top of the body. The valve 85 is supported from the bottom of the body. Identical poppet valve assemblies 202 are mounted on opposite sides of the body providing valve functions corresponding with the opposite side or end sections of the valve 40 for controlling the extend and retract functions of the hydraulic cylinder assembly. The details of the body 200 are shown in FIGS. 25–27. The body has a central rectangular portion 203 provided with an internal rectangular cavity 204. Cylindrical valve body portions 205 extend from the opposite sides of the body for housing the poppet valve assemblies 202. The valve bores of the body portions 205 communicate through cylindrical bores 210 to the central cavity 204 of the body. As seen in FIG. 26, the top of the body is provided with a forward opening 211 for the valve 57 and a rearward opening 212 for the valve 84. Similarly the bottom of the body, FIG. 27, is provided with an opening 213 for the valve 85. The poppet valve body portions 205 each has a poppet valve inlet 214 and a poppet valve outlet 215. The valves 57, 84, 85, and the poppet valves 202 are operated by the hydraulic motor 43 through cam and cross head structure mounted on the motor shaft. Referring to FIGS. 23 and 24, a cam crank 220 is held on the motor shaft 221 of the motor 43 by a retainer 222 secured by a bolt 223. A key 224 is positioned in aligned slots of the shaft and crank for driving the crank as the shaft rotates. As shown in FIGS. 30 and 31, the cam crank 220 has an integral cam 225 for operating the valves 84 and 85 as the cam crank is turned by the motor. The cam also has an integral cross head shaft 230 for driving the cross head of the valve control mechanism. A cross head 231, FIGS. 28 and 29, is coupled with the cross head shaft 230. The cross head has a vertical slot 232 through which the cross head shaft extends. A bushing 233 is fitted on the cross head shaft within the slot 232. The cross head and bushing are held on the cross head shaft by a thrust washer secured on the cross head shaft by a lock ring 235. The cross head shaft has horizontally spaced sidewardly opening slots 240 for coupling the poppet valve assemblies 202 with the cross head. The cams 49 are secured in horizontal spaced relation in the.top portion of the cross head in an upwardly opening recess 241 by cap screws 242. As the cross head reciprocates horizontally the cams 49 operate the valve 57.

The poppet valves assemblies 202 of the valve control mechanism 151, FIGS. 23 and 32–35, each includes a valve seat 250, a valve 251, and a valve operator spool 252. As shown in FIG. 32, the valve seat has a cylindrical externally threaded outer portion 253 which secures the valve seat in the body portion 205. The valve seat also has a tubular inner portion 254 provided with circumferentially spaced elongated flow ports 255. The valve seat portion 254 has a seat surface 260. The bore of the body portion 205 is enlarged along the valve seat providing an annular poppet valve discharge chamber 261 which communicates with the discharge opening 215 in the body portion 205. A ring seal 262 around the valve seat portion 254 seals between the valve seat and the poppet valve body portion 205 inward from the discharge chamber 261. Referring to FIG. 33, the valve 251 has a tubular portion 270 which telescopes into the valve seat tubular portion 254. The tubular portion 270 of the valve is provided with four circumferentially spaced elongated discharge ports 271 which are circumferentially aligned with the discharge port 255 of the valve C so that fluid within the valve portion 270 flows outwardly through the ports 271 of the valve and through the ports 255 of the valve seat into the discharge chamber 261. The valve has an enlarged body portion 272 and an external annular tapered valve seat 273 between the tubular portion 270 and the body portion. The valve seat 273 on the valve is engageable with the valve seat 260 on the valve seat. The tubular portion 270 of the valve fits in close sliding relationship within the tubular portion 254 of the valve seat so that as the valve is moved relative to the valve seat in an axial direction, a linear relationship exists between the valve discharge ports 271 and the valve seat so that the flow rate through the valve is directly proportional to the distance traveled by the valve. For example if the valve is moved 25% of its total travel, the flow rate therethrough is changed 25%. The body portion of the valve is secured with the valve spool 252 by a retainer screw 274. As seen in FIG. 34 the valve spool 252 has an endwardly opening internally threaded blind bore 275 for engagement of the retainer screw 274 in the spool. The bore of the body portion 205 along the valve and spool is enlarged to provide an annular inlet chamber 280 which communicates with the poppet valve inlet port 214. To provide for a tight shut-off between the valve seat and the poppet valve, an area differential between the poppet seal area and the area of the spool is provided so that the shut in pressure within the chamber 280 biases the poppet valve toward the seat. The inward end of the valve spool has upwardly and downwardly opening recesses 281 and flange portions 282 for coupling the valve spools with the cross head in the slots 240 of the cross head. The front of the body 203 of the valve control mechanism is closed by the plate 283 so that the chamber 204 in which the cams and cross head operate is sealed. Such chamber is communicated with the fluid reservoir of the system when the valve control mechanism is connected into the power and logic system such as shown in FIGS. 2A and 2B. The spool 252, and the retainer screw 274 have a longitudinal axial bore 284 which communicates the chamber 204 with the chamber 261 both of which are at reservoir pressure so that there is no pressure differential across the spool.

When the valve control device 151 is connected in a hydraulic power and logic system such as that shown in FIGS. 2A and 2B, the driving of the hydraulic motor 43 turns the cam crank 220 rotating the cam lobe 225 and the cross head shaft 230 which causes the cross head 231 to reciprocate horizontally. As the cam lobe 225 rotates the valves 84 and 85 are operated. As the cross head reciprocates the cam lobes 49 connected with the cross head operate the valve 57. Since the cross head is coupled with the poppet valve spools 284 reciprocation of the spools opens and closes the poppet valves performing the valving function of both sides of the valve 40. At midposition of the cross head both of the poppet valves are open and thus the chambers 202 of both poppet valves communicate with the chambers 261 of the poppet valves so that the pumps **20*a* and 20*b* both communicate with the reservoir and thus are not operating the hydraulic well pump cylinder 7. At each extreme side position of the cross head, the poppet valve on the side to which the cross head is nearest is closed while the opposite poppet valve is fully open. The relationship between the ports in the valve and the ports in the valve seat of the poppet valve provides linear opening of each of the poppet valves so that the valves flow in direct proportion to the extent to which the valve is open. This arrangement provides for direct control of the acceleration and deceleration of the hydraulic well pump which is dependent upon the rates of opening and closing the poppet valves. In other words, the rate at which the hydraulic well pump accelerates or decelerates is directly proportional to the rate at which the poppet valves are opened and closed. That rate is controllable by the rate at which the motor 43 is operated which in turn may be controlled by a manual control of the metering valve 60 in the line 52 supplying hydraulic drive fluid to the motor 43. One of the poppet valves controls the cylinder extension in the hydraulic well pump while the other of the valves controls the cylinder retraction. The hydraulic motor driven cross head or "scotch yoke" mechanism when operating uniformly causes the two poppet valves to alternately open and close in a velocity pattern of harmonic motion. The cam lobes 49 on the cross head operate the limit valve 57** at the extreme right and left positions of the cross head.

The present invention further comprises a method of operating a hydraulic well pump utilizing a hydraulic cylinder assembly. In accordance with one embodiment of the method, the hydraulic cylinder assembly is provided with an additional counterbalancing piston and cylinder and a separate counterbalancing fluid pressure independent of the hydraulic fluid pressure powering the main cylinder assembly is directed into the counterbalancing cylinder below the counterbalancing piston for supporting the combined weights of the sucker rod string, well fluid above the well pump, and the movable parts of the pumping jack supported by the hydraulic cylinder assembly during both the extend and retract strokes. The counterbalancing fluid may be air supplied by a compressor. Another embodiment of the method includes connecting a hydraulic fluid accumulator with both ends of the hydraulic cylinder assembly and the further steps of directing hydraulic fluid from the accumulator into the intake of a hydraulic fluid power pump operating the hydraulic cylinder assembly during extend strokes and directing fluid from the hydraulic cylinder assembly back into the accumulator during retract strokes.

What is claimed is:

1. A system for operating a sucker rod string connected with a well pump comprising:

a double-acting fluid cylinder having opposing power ends;

means for connecting said cylinder with said sucker rod string for raising and lowering said string to operate said pump;

hydraulic pump means for supplying pressurized fluid alternately to the cylinder ends including a direction control movable between extend and retract conditions to extend and retract said cylinder;

drive means for shifting said direction control;

control means for operating said drive means responsive to the extend and retract movements of said cylinder; and means for applying a fluid counterbalancing force into said cylinder for offsetting the combined weights of said sucker rod string, a production fluid column in a well bore above said pump, and movable surface equipment supported on said cylinder including an accumulator connected with said hydraulic pump means and said direction control for supercharging the intake of said pump during said extend movement of said cylinder and for applying an opposing hydraulic force to said cylinder during said retract movement.

2. The system of claim 1 where said accumulator includes a weight operated piston.

3. The system of claim 1 where said accumulator includes a gas operated piston.

4. A hydraulic pumping jack for operating a sucker rod string connected with a well pump comprising:

a double-acting hydraulic cylinder assembly including a base, a stationary piston rod secured along the lower end through said base extending upwardly therefrom, an annular stationary piston secured along an upper end portion of said piston rod, a cylinder movably positioned around said annular piston, a cylinder cap secured on the upper end of said cylinder defining with said cylinder and said annular piston a hydraulic fluid extend chamber within said cylinder above said annular piston, an annular closure between the lower end of said cylinder and said piston rod below said annular piston defining with said annular piston, said cylinder, and said piston rod an annular hydraulic fluid retract chamber below said annular piston, said piston rod having ports along an upper portion thereof below said annular piston for admitting hydraulic fluid to said retract chamber, a flow conductor disposed in spaced concentric relation within said piston rod connecting through said annular piston at an upper end thereof into said extend chamber and connecting through said base for admitting hydraulic fluid into said cylinder assembly to said extend chamber, the outer surface of said flow conductor and the inner surface of said piston rod defining an annular hydraulic fluid flow passage within said piston rod around said flow conductor for hydraulic fluid flow to said annular retract chamber, and flow passage means including a flow coupling in said base comminucating with said annular hydraulic fluid flow passage; an idler sheave platform mounted on the upper end of said cylinder of said hydraulic cylinder assembly; idler sheave means mounted on said sheave platform; flexible tension member means secured at a first fixed end with said hydraulic cylinder assembly platform, extending over said sheave means and downwardly therefrom to a movable second end; means on said second end of said tension member for securing said tension member with a well pump sucker rod string; and hydraulic fluid power and logic circuitry connected with said hydraulic cylinder assembly for extending and retracting said movable cylinder to raise and lower said second movable end of said tension member including a hydraulic fluid accumulator, hydraulic fluid conduit means and valve means connected between said accumulator and said hydraulic cylinder assembly for supercharging a hydraulic fluid pump supplying power fluid to said hydraulic cylinder assembly during extend strokes of said hydraulic cylinder assembly and for directing hydraulic fluid back into said accumulator from the piston rod end of said hydraulic cylinder assembly during retract strokes of said hydraulic cylinder.

5. A well pumping jack in accordance with claim 4 further comprising apparatus for sensing and controlling the extend and retract strokes of said hydraulic cylinder including movably positioned limit valves for sensing the end position of each said extend and retract stroke, said valves being adapted to be selectively positioned for varying said end of each of said strokes and varying the length of said strokes, cam means secured in movable relation with said limit valves for engaging and operating said limit valves, and means for coupling said cam means with said hydraulic cylinder for operating said cam means to simulate said extend and retract strokes of said hydraulic cylinder.

6. A well pumping jack in accordance with claim 5 wherein said means for coupling said hydraulic cylinder and said cam means is a flexible member having a first end connected with said hydraulic cylinder and a second portion spaced from said first end coupled with said cam means for moving said cam means to simulate the movement of said hydraulic cylinder.

7. A pumping jack in accordance with claim 6 further comprising a hydraulic fluid reversing valve for directing flow to the opposite ends of said hydraulic cylinder assembly and means for operating said reversing valve including a hydraulic drive motor actuated responsive to said limit valves and a scotch-yoke coupled between said drive motor and said reversing valve for operating said reversing valve.

8. A system for operating a sucker rod string connected with a well pump conmprising:

a double-acting fluid cylinder having opposing power ends;

means for connecting said cylinder with said sucker rod string for raising and lowering said string to operate said pump;

means for supplying pressurized fluid alternately to the cylinder ends including a hydraulic fluid pump and a direction control movable between extend and retract conditions to extend and retract said cylinder;

drive means for shifting said direction control;

control means for operating said drive means responsive to the extend and retract movements of said cylinder; including limit valves positioned to simulate the hydraulic cylinder extend and retract stroke end locations, said limit valves being movably mounted for changing the location of each limit valve and the distance between said limit valves for selectively adjusting the length of the strokes of said hydraulic cylinder and the end limit of the extend and retract strokes of said cylinder, cam operator means for opening and closing each of said limit valves at said end locations and means connecting said cam operator means with said hydraulic cylinder whereby said cam operator means simulates the extend and retract strokes of said hydraulic cylinder, said means connecting including a flexible cable secured at a first end with said hydraulic cylinder and connected with said cam operator means to move said cam operator means; movable sheave means and fixed sheave means spaced from said movable sheave means, means biasing said movable sheave means away from said fixed sheave means, and said cable is reeved over said movable and fixed sheave means and secured along the second end thereof at a fixed location; and means for applying a fluid counterbalancing force into said cylinder for offsetting the combined weights of said sucker, rod string, a production fluid column in a well bore above said pump, and movable surface equipment supported on said cylinder including a hydraulic fluid accumulator, hydraulic fluid conduit means and valve means connected between said accumulator and said hydraulic cyinder assembly for supercharging said hydraulic fluid pump supplying power fluid to said hydraulic cylinder assembly during extend strokes of said hydraulic cylinder and for directing hydraulic fluid back into said accumulator from the piston rod end of said hydraulic cylinder assembly during retract strokes of said hydraulic cylinder.

9. A system for operating a sucker rod string connected with a well pump comprising:

a double-acting fluid cylinder having opposing power ends;

means for connecting said cylinder with said sucker rod string for raising and lowering said string to operate said pump;

means including a hydraulic fluid pump for supplying pressurized fluid alternately to said cylinder power ends including direction control valve means movable between extend and retract conditions to direct said pressurized fluid into one of said power ends of said cylinder while returning pressurized fluid from the other of said power ends to extend and retract said cylinders;

said direction control valve means comprises spaced fluid control valves having fluid connection, respectively, with the said power ends of said hydraulic cylinder, drive means for shifting said direction control valve means, said drive means includes a rotary fluid motor and a scotch-yoke having a cross head coupling said motor with said direction control valve means;

control means for operating said motor responsive to the extend and retract movements of said cylinder; and means for applying a fluid counterbalancing force into said cylinder for offsetting the combined weights of said sucker rod string, a production fluid column in a well bore above said pump, and movable surface equipment supported on said cylinder including a hydraulic fluid accumulator, hydraulic fluid conduit means and valve means connected between said accumulator and said hydraulic cylinder assembly for supercharging said hydraulic fluid pump supplying power fluid to said hydraulic cylinder assembly during extend strokes of said hydraulic cylinder and for directing hydraulic fluid back into said accumulator from the piston rod end of said hydraulic cylinder assembly during retract strokes of said hydraulic cylinder.

10. In a method of pumping a well having a sucker rod string extending to and operating a well pump in said well, a hydraulic cylinder assembly connected with said sucker rod string, a first hydraulic pump connected with said hydraulic cylinder assembly for operating said assembly through an extend stroke for raising said sucker rod, a second hydraulic pump connected with said hydraulic cylinder assembly for operating said cylinder assembly through a retract stroke for lowering said sucker rod string, a hydraulic fluid accumulator connected with an intake line to said first hydraulic pump, and a bypass line including a valve from said accumulator around said first hydraulic pump into a discharge line from said first hydraulic pump to said hydraulic cylinder assembly, the steps of providing a counterbalancing fluid pressure to said hydraulic cylinder assembly for offsetting the combined weights of said sucker rod string, a column of fluid in said well above said well pump, and well pump components supported by said hydraulic cylinder assembly comprising: directing hydraulic fluid from said accumulator into said intake line of said first hydraulic fluid pump while delivering hydraulic fluid from said pump to said hydraulic cylinder assembly to operate said hydraulic cylinder assembly through said extend stroke; operating said second hydraulic pump for delivering hydraulic fluid from said second hydraulic pump to said hydraulic cylinder assembly to operate said hydraulic cylinder assembly through a retract stroke for lowering said sucker rod string; and simultaneously directing return hydraulic fluid from said hydraulic cylinder assembly through said bypass line around said first hydraulic pump back into said accumulator.

* * * * *